US005534169A

United States Patent [19]

Vinci

[11] Patent Number: 5,534,169

[45] Date of Patent: Jul. 9, 1996

[54] METHODS FOR REDUCING FRICTION BETWEEN RELATIVELY SLIDEABLE COMPONENTS USING METAL CARBOXYLATES

[75] Inventor: James N. Vinci, Mayfield Hts., Ohio

[73] Assignee: The Lubrizol Corporation, Wickliffe, Ohio

[21] Appl. No.: 327,127

[22] Filed: Oct. 21, 1994

Related U.S. Application Data

[63] Continuation of Ser. No. 788,687, Nov. 6, 1991, abandoned, which is a continuation of Ser. No. 554,613, Jul. 18, 1990, abandoned, which is a continuation of Ser. No. 340,902, Apr. 20, 1989, abandoned.

[51] Int. Cl.[6] ..... C10M 129/26; C10M 135/00

[52] U.S. Cl. ..... 508/460; 508/175

[58] Field of Search ..... 252/33, 38, 39, 252/40.5, 41, 42

[56] References Cited

U.S. PATENT DOCUMENTS

| | | | |
|---|---|---|---|
| 3,216,936 | 11/1965 | Le Suer | 252/32.7 |
| 3,216,937 | 11/1965 | Morway et al. | 252/39 |
| 3,219,666 | 11/1965 | Norman et al. | 260/268 |
| 3,234,130 | 2/1966 | Nixon et al. | 252/39 |
| 3,314,886 | 4/1967 | Morway | 252/32.7 |
| 3,372,114 | 3/1968 | Rense | 252/33 |
| 3,372,115 | 3/1968 | McMillen | 252/33 |
| 3,385,792 | 5/1968 | Morway | 252/33.6 |
| 3,492,231 | 1/1970 | McMillen | 252/33 |
| 3,502,677 | 3/1970 | Le Suer | 260/268 |
| 3,708,522 | 1/1973 | Le Suer | 260/485 |
| 3,714,042 | 1/1973 | Greenough | 252/33.2 |
| 3,766,066 | 10/1973 | McMillen | 252/32.7 |
| 3,813,337 | 5/1974 | Sheldahl | 252/33.4 |
| 4,230,586 | 10/1980 | Bretz et al. | 252/8.5 |
| 4,468,339 | 8/1984 | Rysek et al. | 252/75 |
| 4,505,830 | 3/1985 | Vinci | 252/42 |
| 4,560,488 | 12/1985 | Vinci | 252/33 |
| 4,659,488 | 4/1987 | Vinci | 252/33 |
| 4,698,170 | 10/1987 | Le Coent | 252/33.2 |
| 4,719,023 | 1/1988 | MacPhail et al. | 252/39 |
| 4,784,781 | 11/1988 | Denis et al. | 252/39 |
| 4,787,992 | 11/1988 | Waynick | 252/18 |
| 4,792,410 | 12/1988 | Schwind et al. | 252/38 |
| 4,824,585 | 4/1989 | Marotel | 252/39 |
| 4,938,882 | 7/1990 | Tipton | 252/41 |

FOREIGN PATENT DOCUMENTS

| | | |
|---|---|---|
| 2014880 | 10/1970 | Germany . |
| 2362596 | 6/1975 | Germany . |
| 0111396 | 7/1982 | Japan . |
| 0147095 | 8/1984 | Japan . |
| 0204695 | 11/1984 | Japan . |
| 1059848 | 2/1967 | United Kingdom . |
| 8706256 | 10/1987 | WIPO . |

*Primary Examiner*—Jacqueline V. Howard
*Attorney, Agent, or Firm*—Frederick D. Hunter

[57] ABSTRACT

A method and compositions for reducing friction between relatively slideable components is described comprising applying to a slideably engaging surface of the slideable components a lubricating amount of at least one Newtonian, or non-Newtonian, metal overbased salt of a carboxylic acid wherein the metal is selected from the group consisting of lithium, calcium, sodium, barium, magnesium, and mixtures thereof, and the carboxylic acid comprises at least one linear unsaturated hydrocarbon group containing from about 8 to about 50 carbon atoms. The types of slideable components contemplated include flat bearings, rotating bearings, lead screws and nuts, gears, hydraulic systems, and pneumatic devices. The inventors have discovered that applying a metal overbased salt of the aforesaid carboxylic acids results in a remarkable reduction in static and dynamic coefficients of friction and provides anti-wear protection of an extreme pressure agent without requiring auxiliary friction-modifying agents or auxiliary extreme pressure agents.

18 Claims, No Drawings

METHODS FOR REDUCING FRICTION BETWEEN RELATIVELY SLIDEABLE COMPONENTS USING METAL CARBOXYLATES

This is a continuation of application Ser. No. 07/788,687 filed on Nov. 6, 1991, which is a continuation of Ser. No. 07/554,613, filed on Jul. 18, 1990, which is a continuation of Ser. No. 07/340,092, filed on Apr. 20, 1989, all now abandoned.

FIELD OF THE INVENTION

This invention relates to a method for reducing friction between relatively slideable components comprising applying to a slideably engaging surface of a slideable component a lubricating amount of at least one metal overbased salt of a carboxylic acid. Slideable components include flat bearings, rotating bearings, lead screws and nuts, gears, hydraulic systems, and pneumatic devices.

BACKGROUND OF THE INVENTION

Industrial lubricants are often required to provide good friction reducing properties under thin-film or boundary conditions. Flat bearings, such as slideways, guides and ways used on forging and stamping presses; as crosshead guides of certain compressors, diesel and steam engines; and on metalworking machines such as lathes, grinders, planers, shapers and milling machines, for example, can present special problems. At low speeds and under heavy loads, the lubricant tends to be wiped off so that boundary lubrication prevails. Machine tools for precision machining in particular generally require slides and ways to operate under boundary conditions at all times. A phenomenon known as "stick slip" can be encountered in the motion of slides and ways if the static coefficient of friction of the lubricant is greater than the dynamic coefficient, requiring more force to start the sliding motion from rest than that required to maintain the motion after it has started.

Another phenomenon known as "float" can be encountered in the motion of slides and ways with low loads and high traverse speeds if the oil viscosity is high, resulting in lifting the slide from the way which, with variations in speed or load, can vary the lubricant film thickness enough to produce wavy surfaces on parts being machined, or cause parts to be made offsize.

Rotating bearings, such as plain bearings or anti-friction (i.e., rolling) bearings, lead screws and nuts, gears, hydraulic systems, and pneumatic devices also often encounter low speed and heavy load conditions, particularly in an industrial setting where these are often components found in machine tools and other heavy industrial machinery, although low speed/heavy load conditions sometimes are found in non-industrial settings as well, such as in components found in land vehicles, ships and aircraft. Lead screws and nuts are often used, for example, to control the flaps on the wings of medium to large airplanes.

Improved friction reduction and reduced stick slip under boundary conditions has generally required employing friction reducing and extreme pressure/antiwear additives in the lubricant to compensate for the corresponding deficiencies in the lubricant oil.

Many friction-modifying or extreme pressure/antiwear additives, however, often have problems such as toxicity to humans, unpleasant smell such as from the release of sulfur gases from extreme pressure/antiwear agents containing sulfur, and/or the addition of an opaque color making equipment maintenance difficult and messy, so that it is advantageous to obtain the desired friction-modification and extreme pressure/antiwear properties without such additives. With the invention presented in this application, the inventors have found that metal overbased unsaturated linear hydrocarbon carboxylates are able to achieve the desired friction reducing and extreme pressure/antiwear protection without additional friction-modifying or extreme pressure/antiwear additives.

In addition, friction-modifying and extreme pressure/antiwear additives may be advantageously added to the metal overbased carboxylates used in the present invention to achieve even greater friction-modifying and extreme pressure/antiwear properties.

The terms "overbased", "superbased", and "hyperbased", are terms of art which are generic to well known classes of metal-containing materials which for the last several decades have been employed as detergents and/or dispersants in lubricating oil compositions. These overbased materials which have also been referred to as "complexes", "metal complexes", "high-metal containing salts", and the like, are characterized by a metal content in excess of that which would be present according to the stoichiometry of the metal and the particular organic compound reacted with the metal, e.g., a carboxylic or sulfonic acid.

Newtonian overbased materials and non-Newtonian colloidal disperse systems comprising solid metal-containing colloidal particles pre-dispersed in a disperse medium of at least one inert organic liquid and a third component selected from the class consisting of organic compounds which are substantially insoluble in said disperse medium are known. See, for example, U.S. Pat. Nos. 3,492,231; and 4,230,586.

Carboxylic acid derivatives made from high molecular weight carboxylic acid acylating agents and amino compounds and their use in oil-based lubricants are well known. See, for example, U.S. Pat. Nos. 3,216,936; 3,219,666; 3,502,677; and 3,708,522.

Metal working lubricants containing a lubricating oil and a basic metal salt or borated complex thereof, including overbased carboxylates, are described in U.S. Pat. Nos. 4,659,488; 4,505,830; and 3,813,337.

SUMMARY OF THE INVENTION

The present invention comprises a method for reducing friction between relatively slideable components comprising applying to a slideably engaging surface of the slideable components a lubricating amount of at least one Newtonian, or non-Newtonian, metal overbased salt of a carboxylic acid wherein the metal is selected from the group consisting of lithium, calcium, sodium, barium, magnesium, and mixtures thereof, and the carboxylic acid comprises at least one linear unsaturated hydrocarbon group containing from about 8 to about 50 carbon atoms. The types of slideable components contemplated include flat bearings, rotating bearings, lead screws and nuts, gears, hydraulic systems, and pneumatic devices. The inventors have discovered that applying a metal overbased salt of the aforesaid carboxylic acids results in a remarkable reduction in static and dynamic coefficients of friction and provides anti-wear protection of an extreme pressure agent without requiring auxiliary friction-modifying agents or auxiliary extreme pressure agents.

The present invention further comprises the compositions for reducing friction between relatively slideable components comprising at least one Newtonian or non-Newtonian metal overbased salt of a carboxylic acid wherein the metal is selected from the group consisting of lithium, calcium, sodium, barium, magnesium, and mixtures thereof, and carboxylic acid comprises at least one linear unsaturated hydrocarbon group containing from about 8 to about 50 carbon atoms, to which functional additives, such as auxiliary extreme pressure/antiwear and friction-modifying agents may be advantageously added.

DETAILED DESCRIPTION OF THE PREFERRED EMBODIMENT

The Overbased Material:

As indicated above, the terms "overbased," "superbased," and "hyperbased," are terms of art which are generic to well known classes of metal-containing materials which have generally been employed as detergents and/or dispersants in lubricating oil compositions. These overbased materials have also been referred to as "complexes," "metal complexes," "high-metal containing salts," and the like. Overbased materials are characterized by a metal content in excess of that which would be present according to the stoichiometry of the metal and the particular organic compound reacted with the metal, e.g., a carboxylic or sulfonic acid. Thus, if a monocarboxylic acid,

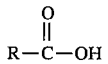

is neutralized with a basic metal compound, e.g., calcium hydroxide, the "normal" metal salt produced will contain one equivalent of calcium for each equivalent of acid, i.e.,

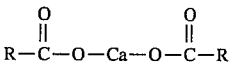

However, as is well known in the art, various processes are available which result in an inert organic liquid solution of a product containing more than the stoichiometric amount of metal. The solutions of these products are referred to herein as overbased materials. Following these procedures, the carboxylic acid or an alkali or alkaline earth metal salt thereof can be reacted with a metal base and the product will contain an amount of metal in excess of that necessary to neutralize the acid, for example, 4.5 times as much metal as present in the normal salt or a metal excess of 3.5 equivalents.

The actual stoichiometric excess of metal can vary considerably, for example, from about 0.1 equivalent to about 50 or more equivalents depending on the reactions, the process conditions, and the like. The overbased materials useful in accordance with the present invention contain from about 1.1 to about 40 or more, preferably from about 6.0 to about 30, and more preferably from about 15 to about 30, equivalents of metal for each equivalent of material which is overbased.

In the present specification and claims the term "overbased" is used to designate materials containing a stoichiometric excess of metal and is, therefore, inclusive of those metals which have been referred to in the art as overbased, superbased, hyperbased, etc., as discussed supra.

The terminology "metal ratio" is used in the prior art and herein to designate the ratio of the total chemical equivalents of the metal in the overbased material (e.g., a metal sulfonate or carboxylate) to the chemical equivalents of the metal in the product which would be expected to result in the reaction between the organic material to be overbased (e.g., sulfonic or carboxylic acid) and the metal-containing reactant (e.g., calcium hydroxide, barium oxide, etc.)according to the known chemical reactivity and stoichiometry of the two reactants. Thus, in the normal calcium sulfonate discussed above, the metal ratio is one, and in the overbased sulfonate, the metal ratio is 4.5. Obviously, if there is present in the material to be overbased more than one compound capable of reacting with the metal, the "metal ratio" of the product will depend upon whether the number of equivalents of metal in the overbased product is compared to the number of equivalents expected to be present for a given single component or a combination of all such components.

Generally, these overbased materials are prepared by treating a reaction mixture comprising the organic material to be overbased, a reaction medium consisting essentially of at least one inert, organic solvent for said organic material, a stoichiometric excess of a metal base, and a promoter with an acidic material. The methods for preparing the overbased materials as well as an extremely diverse group of overbased materials are well known in the prior art and are disclosed for example in the following U.S. Pat. Nos. 2,616,904; 2,616,905; 2,616,906, 2,616,911; 2,616,924; 2,616,925; 2,617,049; 2,695,910; 2,723,234; 2,723,235; 2,723,236; 2,760,970; 2,767,164; 2,767,209; 2,777,874; 2,798,852; 2,839,470; 2,856,359; 2,859,360; 2,856,361; 2,861,951; 2,883,340; 2,915,517; 2,959,551; 2,968,642; 2,971,014; 2,989,463; 3,001,981; 3,027,325; 3,070,581; 3,108,960; 3,147,232; 3,133,019; 3,146,201; 3,152,991; 3,155,616; 3,170,880; 3,170,881; 3,172,855; 3,194,823; 3,223,630; 3,232,883; 3,242,079; 3,242,080; 3,250,710; 3,256,186; 3,274,135; 3,492,231; and 4,230,586. These patents disclose processes, materials which can be overbased, suitable metal bases, promoters, and acidic materials, as well as a variety of specific overbased products useful in producing the disperse systems of this invention and are, accordingly, incorporated herein by reference.

An important characteristic of the organic materials which are overbased is their solubility in the particular reaction medium utilized in the overbasing process. As the reaction medium used previously has normally comprised petroleum fractions, particularly mineral oils, these organic materials have generally been oil-soluble. However, if another reaction medium is employed (e.g. aromatic hydrocarbons, aliphatic hydrocarbons, kerosene, etc.) it is not essential that the organic material be soluble in mineral oil as long as it is soluble in the given reaction medium. Obviously, many organic materials which are soluble in mineral oils will be soluble in many of the other indicated suitable reaction mediums. It should be apparent that the reaction medium usually becomes the disperse medium of the colloidal disperse system or at least a component thereof depending on whether or not additional inert organic liquid is added as part of the reaction medium or the disperse medium.

Suitable carboxylic acids include aliphatic, cycloaliphatic and aromatic mono- and polybasic carboxylic acids, including linear alkenyl-substituted cyclopentanoic acids, linear alkenyl-substituted cyclohexanoic acids, and linear alkenyl-substituted aromatic carboxylic acids. These aliphatic acids generally contain from about 8 to about 50, and preferably from about 12 to about 25, carbon atoms. The unsaturated linear aliphatic carboxylic acids are preferred. Specific examples of the preferred unsaturated linear aliphatic carboxylic acids include abietic acid, linolenic acid, palmitoleic acid, linoleic acid, oleic acid, ricinoleic acid, alkenyl-succinic acids, and commercially available mixtures of two or more carboxylic acids, such as tall oil acids, and the like.

The metal compounds used in preparing the overbased materials are normally the basic salts of metals in Group I-A and Group II-A of the Periodic Table. In particular, metals selected from the group consisting of lithium, calcium, sodium, barium, magnesium, and mixtures thereof, have been found to be useful for the present invention, and lithium, calcium, and mixtures thereof, are particularly preferred due to the good lubricating properties and low toxicity of lithium and calcium, respectively.

The promoters, that is, the materials which permit the incorporation of the excess metal into the overbased material, are also quite diverse and well known in the art as evidenced by the cited patents. A particularly comprehensive discussion of suitable promoters is found in U.S. Pat. Nos. 2,777,874; 2,695,910; and 2,616,904. These include the alcoholic and phenolic promoters which are preferred. The alcoholic promoters include the alkanols of one to about twelve carbon atoms such as methanol, ethanol, n-butanol, amyl alcohol, octanol, isopropanol, isobutanol, and mixtures of these and the like. Phenolic promoters include a variety of hydroxy-substituted benzenes and naphthalenes. A particularly useful class of phenols are the alkylated phenols of the type listed in U.S. Pat. No. 2,777,874, e.g., heptylphenols, octylphenols, and nonylphenols. Mixtures of various promoters are sometimes used.

Suitable acidic materials are also disclosed in the above-cited patents, for example, U.S. Pat. No. 2,616,904. Included within the known group of useful acidic materials are liquid acids such as formic acid, acetic acid, nitric acid, sulfuric acid, hydrochloric acid, hydrobromic acid, carbamic acid, substituted carbamic acids, etc. Acetic acid is a very useful acidic, material although inorganic acidic materials such as HCl, $SO_2$, $SO_3$, $CO_2$, $H_2S$, $N_2O_3$, etc., are ordinarily employed as the acidic materials. The most preferred acidic materials are carbon dioxide and acetic acid.

In preparing overbased materials, the material to be overbased, an inert, non-polar, organic solvent therefor, the metal base, the promoter and the acidic material are brought together and a chemical reaction ensues. The exact nature of the resulting overbased product is not known. However, it can be adequately described for purposes of the present specification as a single phase homogeneous mixture of the solvent and (1) either a metal complex formed from the metal base, the acidic material, and the material being overbased and/or (2) an amorphous metal salt formed from the reaction of the acidic material with the metal base and the material which is said to be overbased. Thus, if mineral oil is used as the reaction medium, carboxylic acid as the material which is overbased, $Ca(OH)_2$ as the metal base, and carbon dioxide as the acidic material, the resulting overbased material can be described for purposes of this invention as an oil solution of either a metal containing complex of the acidic material, the metal base, and the carboxylic acid or as an oil solution of amorphous calcium carbonate and calcium carboxylate.

The temperature at which the acidic material is contacted with the remainder of the reaction mass depends to a large measure upon the promoting agent used. With a phenolic promoter, the temperature usually ranges from about 80° C. to 300° C., and preferably from about 100° C. to about 200° C. When an alcohol or mercaptan is used as the promoting agent, the temperature usually will not exceed the reflux temperature of the reaction mixture, and preferably will not exceed about 100° C.

In view of the foregoing, it should be apparent that the overbased materials may retain all or a portion of the promoter. That is, if the promoter is not volatile (e.g., an alkyl phenol) or otherwise readily removable from the overbased material, at least some promoter remains in the overbased product. Accordingly, the disperse systems made from such products may also contain the promoter. The presence or absence of the promoter in the overbased material used in the present invention does not represent a critical aspect of the invention. Obviously, it is within the skill of the art to select a volatile promoter such as a lower alkanol, e.g., methanol, ethanol, etc., so that the promoter can be readily removed.

Especially preferred for use in the present invention are metal salts having metal ratios from about 1.1 to about 40, preferably from about 6 to about 30 and especially from about 8 to about 25, and prepared by intimately contacting for a period of time sufficient to form a stable dispersion, at a temperature between the solidification temperature of the reaction mixture and its decomposition temperature, (B-1) at least one acidic gaseous material selected from the group consisting of carbon dioxide, hydrogen sulfide, and sulfur dioxide with (B-2) a reaction mixture comprising (B-2-a) at least one alkali or alkaline earth metal or basic alkali or alkaline earth metal compound;

(B-2-b) at least one lower aliphatic alcohol; and (B-2-c) at least one carboxylic acid or functional derivative thereof having an unsaturated linear hydrocarbon group containing from about 8 to about 50 carbon atoms which is susceptible to overbasing.

Component B-2-a is at least one alkali or alkaline earth metal. Illustrative of basic alkali or alkaline earth metal compounds are the hydroxides, alkoxides (typically those in which the alkoxy group contains up to 10 and preferably up to 7 carbon atoms), hydrides and amides. Thus, useful basic alkaline earth metal compounds include lithium hydroxide, calcium hydroxide, magnesium hydroxide, sodium hydroxide, barium hydroxide, calcium oxide, magnesium oxide, barium oxide, lithium hydride, calcium hydride, magnesium hydride, barium hydride, calcium ethoxide, calcium butoxide and calcium amide, etc. Especially preferred are calcium oxide and calcium hydroxide and the calcium lower alkoxides (i.e., those containing up to 7 carbon atoms). The equivalent weight of the at least one alkaline earth metal or basic alkaline earth metal compound for the purpose of this invention is equal to twice its molecular weight, since the alkaline earth metals are divalent.

Component B-2-b is at least one lower aliphatic alcohol, and is preferably a monohydric or dihydric alcohol. Illustrative alcohols are methanol, ethanol, n-butanol, 1-propanol, 1-hexanol, amyl alcohol, isopropanol, isobutanol, 2-pentanol, 2,2-dimethyl-1-propanol, ethylene glycol, 1-3-propanediol and 1,5-pentanediol. Of these, the preferred alcohols are methanol, ethanol, propanol, and mixtures of isobutanol and amyl alcohol, with methanol and mixtures of isobutanol and amyl alcohol being especially preferred. The equivalent weight of component B-2-b is its molecular weight divided by the number of hydroxy groups per molecule.

Component B-2-c is at least one carboxylic acid as previously described, or functional derivative thereof. Especially suitable carboxylic acids are those of the formula $R^5(COOH)_n$, wherein n is an integer from 1 to 6 and is preferably 1 or 2 and $R^5$ is an unsaturated linear aliphatic hydrocarbon radical having at least 8 aliphatic carbon atoms. Depending upon the value of n, $R^5$ will be a monovalent to hexavalent radical.

$R^5$ may contain non-hydrocarbon substituents provided they do not alter substantially its hydrocarbon character.

Such substituents are preferably present in amounts of not more than about 10% by weight. Exemplary substituents include non-hydrocarbon substituents such as mercapto, halo, nitro, amino, nitroso, lower alkylmercapto, carbalkoxy, oxo, thio, or interrupting groups such as —NH—, —O— or —S— as long as the essentially linear unsaturated hydrocarbon character thereof is not destroyed. $R^5$ contains olefinic unsaturation, and preferably contains more than 5% olefinic linkages based upon the total number of carbon-to-carbon covalent linkages present. The number of carbon atoms in $R^5$ is usually about 8–50 depending upon the source of $R^5$.

As discussed below, a preferred series of carboxylic acids and derivatives is prepared by reacting an olefin polymer or halogenated olefin polymer with an alpha, beta-unsaturated acid or its anhydride such as acrylic, methacrylic, maleic or fumaric acid or maleic anhydride to form the corresponding substituted acid or derivative thereof.

The monocarboxylic acids useful as component B-2-c have the formula $R^5COOH$. Examples of such acids are linoleic, abietic, linolenic, palmitoleic, oleic, and ricinoleic acids and commercial mixtures of fatty acids such as tall oil fatty acids. A particularly preferred group of monocarboxylic acids is prepared by the reaction of a halogenated olefin polymer, such as a chlorinated polybutene, with acrylic acid or methacrylic acid.

Suitable dicarboxylic acids include the substituted succinic acids having the formula.

$$\begin{array}{c} R^6CHCOOH \\ | \\ CH_2COOH \end{array}$$

wherein $R^6$ is the same as $R^5$ as defined above.

The above-described classes of carboxylic acids and their derivatives, are well known in the art, and methods for their preparation as well as representative examples of the types useful in the present invention are described in detail in a number of U.S. patents.

Functional derivatives of the above-discussed acids useful as component B-2-c includes the anhydrides, esters, amides, imides, amidines and metal salts so long as at least one carboxyl group continues to exist and the unsaturated linear hydrocarbon group substantially retains its unsaturated linear hydrocarbon nature. The reaction products of olefin polymer-substituted succinic acids and mono- or polyamines, particularly polyalkylene polyamines, having up to about ten amino nitrogens are especially suitable. These reaction products generally comprise mixtures of one or more of amides, imides and amidines. The reaction products of polyethylene amines containing up to about 10 nitrogen atoms and polybutene-substituted succinic anhydride wherein the polybutene radical comprises principally isobutene units are particularly useful. Included in this group of functional derivatives are the compositions prepared by post-treating the amine-anhydride reaction product with carbon disulfide, boron compounds, nitriles, urea, thiourea, guanidine, alkylene oxides or the like. The half-amide, half-metal salt and half-ester, half-metal salt derivatives of such substituted succinic acids are also useful.

Also useful are the esters prepared by the reaction of the substituted acids or anhydrides with a mono- or polyhydroxy compound, such as an aliphatic alcohol or a phenol. Preferred are the esters of olefin polymer-substituted succinic acids or anhydrides and polyhydric aliphatic alcohols containing 2–10 hydroxy groups and up to about 40 aliphatic carbon atoms. This class of alcohols includes ethylene glycol, glycerol, sorbitol, pentaerythritol, polyethylene glycol, diethanolamine, triethanolamine, N,N-di(hydroxyethyl-)ethylene diamine and the like. When the alcohol contains reactive amino groups, the reaction product may comprise products resulting from the reaction of the acid group with both the hydroxy and amino functions. Thus, this reaction mixture can include half-esters, half-amides, esters, amides, and imides.

The ratios of equivalents of the constituents of reagent B-2 may vary widely. In general, the ratio of component B-2-a to B-2-c is at least about 4:1 and usually not more than about 50:1, preferably between 6 and 30:1 and most preferably between 8:1 and 25:1. The ratio of equivalents of component B-2-b to component B-2-c is between about 1:1 and 80:1, and preferably between about 2:1 and 50:1.

Reagents B-1 and B-2 are generally contacted until there is no further reaction between the two or until the reaction substantially ceases. While it is usually preferred that the reaction be continued until no further overbased product is formed, useful dispersions can be prepared when contact between reagents B-1 and B-2 is maintained for a period of time sufficient for about 70% of reagent B-1, relative to the amount required if the reaction were permitted to proceed to its completion or "end point", to react.

The point at which the reaction is completed or substantially ceases may be ascertained by any of a number of conventional methods. One such method is measurement of the amount of gas (reagent B-1) entering and leaving the mixture; the reaction may be considered substantially complete when the amount leaving is about 90–100% of the amount entering. These amounts are readily determined by the use of metered inlet and outlet valves.

The reaction temperature is not critical. Generally, it will be between the solidification temperature of the reaction mixture and its decomposition temperature (i.e., the lowest decomposition temperature of any component thereof). Usually, the temperature will be from about 25° to about 200° C. and preferably from about 150° C. Reagents B-1 and B-2 are conveniently contacted at the reflux temperature of the mixture. This temperature will obviously depend upon the boiling points of the various components; thus, when methanol is used as component B-2-b, the contact temperature will be about the reflux temperature of methanol.

The reaction is ordinarily conducted at atmospheric pressure, although an elevated pressure often expedites the reaction and promotes optimum utilization of reagent B-1. The process can also be carried out at reduced pressure but, for obvious practical reasons, this is rarely done.

The reaction is usually conducted in the presence of a substantially inert, normally liquid, organic diluent, which functions as both the dispersing and reaction medium. This diluent will comprise at least about 10% of the total weight of the reaction mixture. Ordinarily it will not exceed about 80% by weight, and it is preferably about 30–70% thereof.

Although a wide variety of diluents are useful, it is preferred to use a diluent which is soluble in lubricating oil. The diluent usually itself comprises a lower viscosity lubricating oil.

Other organic diluents can be employed either alone or in combination with lubricating oil. Preferred diluents for this purpose include the aromatic hydrocarbons such as bezene, toluene and xylene; halogenated derivatives thereof such as chlorobenzene; lower boiling petroleum distillates such as petroleum ether and the various naphthas; normally liquid aliphatic and cycloaliphatic hydrocarbons such as hexane, heptane, hexene, cyclohexene, cyclopentane, cyclohexane and ethylcyclohexane, and their halogenated derivatives. Dialkyl ketones such as dipropyl ketone and ethyl butyl ketone, and the alkyl aryl ketones such as acetophenone, are likewise useful, as are ethers such as n-propyl ether, n-butyl ether, n-butyl methyl ether and isoamyl ether.

When a combination of oil and other diluent is used, the weight ratio of oil to the other diluent is generally from about 1:20 to about 20:1. It is usually desirable for a mineral lubricating oil to comprise at least about 50% by weight of the diluent, especially if the product is to be used as a lubricant additive. The total amount of diluent present is not particularly critical since it is inactive. However, the diluent will ordinarily comprise about 10–80% and preferably about 30–70% by weight of the reaction mixture.

The reaction is preferably conducted in the absence of water, although small amounts may be present (e.g., because of the use of technical grade reagents). Water may be present in amounts up to about 10% by weight of the reaction mixture without having harmful effects.

Upon completion of the reaction, any solids in the mixture are preferably removed by filtration or other conventional means. Optionally, readily removable diluents, the alcoholic promoters, and water formed during the reaction can be removed by conventional techniques such as distillation. It is usually desirable to remove substantially all water from the reaction mixture, since the presence of water may lead to difficulties in filtration and to the formation of undesirable emulsions in fuels and lubricants. Any such water present is readily removed by heating at atmospheric or reduced pressure or by azeotropic distillation.

The chemical structure of component B is not known with certainty. The basic salts or complexes may be solutions or, more likely, stable dispersions. Alternatively, they may be regarded as "polymeric salts" formed by the reaction of the acidic material, the oil-soluble acid being overbased, and the metal compound. In view of the above, these compositions are most conveniently defined by reference to the method by which they are formed.

U.S. Pat. No. 3,377,283 is incorporated by reference herein for its disclosure of compositions suitable for use as component B and methods for their preparation.

The following are examples illustrating preparation of the metal overbased salts of carboxylic acids for use in the present invention. The term "base number" or "neutralization base number" used therein is referenced against a phenolphthalein indicator and, unless stated otherwise, all parts, percentages, ratios and the like are by weight, temperature is room temperature (approximately 25° C.), and pressure is atmospheric pressure (approximately 1 atmosphere).

EXAMPLE 1

A mixture of 902.6 parts of mineral oil, 153.3 parts polyisobutylene (average molecular weight of 940) succinic acid anhydride, PM3101™ (a mixture of 61% by weight isobutanol and 39% by weight amyl alcohol commercially available from Union Carbide Corp.), and Mississippi Lime (86% available Ca) are charged to a stainless steel reactor having a stirrer, condenser, and an oil system to a jacket around the reactor for both heating and cooling. With stirrer agitation of the mixture and a nitrogen gas purge above the reaction mixture, 1000 parts tall oil fatty acids (commercially available from suppliers, such as Unitol DSR-8 from Union Camp Corp.) are added over a period of 3 hours. The mixture is then heated to 190° F. to complete the acid and acid anhydride neutralization. 118.9 parts methanol and 726.5 parts of the above-mentioned Mississippi Lime are added after cooling the batch to 105° F. The material in the reaction vessel is carbonated at 106° to 113° F. by passing carbon dioxide into the reaction mixture until the reaction mixture has a base number of approximately zero. After carbonation, the material is flash dried to remove the alcohol promoters and water by raising the temperature to 300° F. and purging with nitrogen gas.

The material is then cooled, solvent clarified by adding approximately 150 parts hexane, and vacuum stripped of volatiles to 300° F. and 70 mm absolute Hg. The product is filtered and diluent oil is added to adjust calcium content (requires about 111 parts added diluent oil to adjust product to 14.2% by weight calcium).

The product is the desired metal overbased carboxylate utilized in the present invention.

EXAMPLE 2

To 1045 parts of Semtol-70 Oil™, a medium boiling mineral oil commercially available from Witco Corporation, 487 parts PM3101™ (a mixture of 61% by weight isobutanol and 39% by weight primary amyl alcohol (containing 57–70% n-amyl alcohol) commercially available from Union Carbide Corp.), and 162 parts Mississippi Codex Lime (97% available CaOH) is added 1000 parts oleic acid over a period of 3 hours. The mixture is heated to 170° F. to complete the acid neutralization. After cooling the batch to 105° F., 119 parts methanol and 726.5 parts of the Mississippi Codex Lime are added. This mixture is carbonated by blowing carbon dioxide through the under-surface inlet tube until the mixture has a neutralization base number of approximately zero. The alcohol promoter and water are removed by flash drying, the material is cooled, solvent clarified with hexane, and vacuum stripped to 300° F. and 70 mm absolute Hg.

The final product is essentially environmentally safe, non-toxic, calcium overbased oleic acid having a metal ratio of 9.0.

The metal overbased carboxylate may be used in its Newtonian form by itself, in combination with an oil of lubricating viscosity, a grease, and/or functional additives, or may be converted into a non-Newtonian colloidal disperse system (i.e., a colloidal gel) if an inherent grease-like property is desired.

The terminology "disperse system" as used in the specification and claims is a term of art generic to colloids or colloidal solutions, e.g., "any homogeneous medium containing dispersed entities of any size and state," Jirgensons and Straumanis, "A Short Textbook on Colloidal Chemistry" (2nd Ed.) The Macmillan Co., New York, 1962 at page 1. However, the particular disperse systems of the present invention form a subgenus within this broad class of disperse system, this subgenus being characterized by several important features.

This subgenus comprises those disperse systems wherein at least a portion of the particles dispersed therein are solid, metal-containing particles formed in situ. At least about 10% to about 50% are particles of this type and preferably substantially all of said solid particles are formed in situ.

So long as the solid particles remain dispersed in the dispersing medium as colloidal particles, the particle size is not critical. Ordinarily, the particles will not exceed a number average particle size of 5.0 microns. However, it is preferred that the number average particle size be less than or equal to about 2.0 microns. In a more preferred aspect of the invention, the number average particle size is less than or equal to 2.0 microns and more than 80 number percent of the solid metal-containing particles have a particle size less than 5.0 microns. In a particularly preferred aspect of the invention, the number average particle size is less than or equal to 1.0 micron and more than 80 number percent of the solid metal-containing particles have a particle size less than about 2.0 microns.

The number average particle size is the sum of the particle size of the solid metal-containing colloidal particles per unit volume divided by the number of particles in the unit volume. This average particle size determination may be made using, for example, an instrument known as a Nicomp Model 270 commercially available from Specific Scientific Co., which uses quasi elastic light scattering (i.e., QELS), a laser light scattering method for determining particle size which is well known to those of ordinary skill in the colloidal dispersion art.

Systems having a number average unit particle size of less than or equal to 2.0 microns, are preferred, and those having a number average unit particle size less than or equal to 1.0 micron is more preferred. Systems having a unit particle size in the range from 0.03 micron to 0.5 micron give excellent results. The minimum unit particle size is at least 0.02 micron and preferably at least 0.03 micron.

The language "unit particle size", as opposed to "particle size", is intended to designate the average particle size of the solid, metal-containing particles assuming maximum dispersion of the individual particles throughout the disperse medium. That is, the unit particle is that particle which corresponds in size to the average size of the metal-containing particles and is capable of independent existence within the disperse system as a discrete colloidal particle. These metal-containing particles are found in two forms in the disperse systems of the present invention. Individual unit particles can be dispersed as such throughout the medium or unit particles can form an agglomerate, in combination with other materials (e.g., another metal-containing particle, the disperse medium, etc.) which are present in the disperse systems. These agglomerates are dispersed through the system as "metal-containing particles". Obviously, the "particle size" of the agglomerate is substantially greater than the unit particle size.

Furthermore, it is equally apparent that this agglomerate size is subject to wide variations, even within the same disperse system. The agglomerate size varies, for example, with the degree of shearing action employed in dispersing the unit particles. That is, mechanical agitation of the disperse system tends to break down the agglomerates into the individual components thereof and disperse these individual components throughout the disperse medium. The ultimate in dispersion is achieved when each solid, metal-containing particle is individually dispersed in the medium.

Accordingly, the disperse systems may be characterized with reference to the unit particle size, it being apparent to those skilled in the art that the unit particle size represents the average size of solid, metal-containing particles present in the system which can exist independently. The number average particle size of the metal-containing solid particles in the system can be made to approach the unit particle size value by the application of a shearing action to the existent system or during the formation of the disperse system as the particles are being formed in situ. It is not necessary that maximum particle dispersion exist to have useful disperse systems. The agitation associated with homogenization of the overbased material and conversion agent produces sufficient particle dispersion.

Basically, the solid metal-containing particles are in the form of metal salts of inorganic acids, and low molecular weight organic acids, hydrates thereof, or mixtures of these. These salts are usually the alkali and alkaline earth metal formates, acetates, carbonates, sulfides, sulfites, sulfates, thiosulfates, and halides, among which the carbonates are preferred. In other words, the metal-containing particles are ordinarily particles of metal salts, the unit particle is the individual salt particle, and the unit particle size is the number average particle size of the salt particles which is readily ascertained, as for example, by conventional X-ray diffraction techniques or laser light scattering, such as the above-mentioned QELS method. Colloidal disperse systems possessing particles of this type are sometimes referred to as macromolecular colloidal systems.

Because of the composition of the colloidal disperse systems of this invention, the metal-containing particles also exist as components in micellar colloidal particles. In addition to the solid metal-containing particles and the disperse medium, the colloidal disperse systems of the invention are characterized by a third component, one which is soluble in the medium and contains in the molecules thereof a hydrophobic portion and at least one polar substituent. This third component can orient itself along the external surfaces of the above metal salts, the polar groups lying along the surface of these salts with the hydrophobic portions extending from the salts into the disperse medium forming micellar colloidal particles. These micellar colloids are formed through weak intermolecular forces, e.g., Van der Waals forces, etc. Micellar colloids represent a type of agglomerate particle as discussed hereinabove. Because of the molecular orientation in these micellar colloidal particles, such particles are characterized by a metal containing layer (i.e., the solid metal-containing particles and any metal present in the polar substituent of the third component, such as the metal in a sulfonic or carboxylic acid salt group), a hydrophobic layer formed by the hydrophobic portions of the molecules of the third component and a polar layer bridging said metal-containing layer and said hydrophobic layer, said polar bridging layer comprising the polar substituents of the third component of the system, e.g., the $$-\overset{\overset{\displaystyle O}{\|}}{C}-O-$$

group if the third component is an alkaline earth metal carboxylate.

The second component of the colloidal disperse system is the dispersing medium. The identity of the medium is not a particularly critical aspect of the invention as the medium primarily serves as the liquid vehicle in which solid particles are dispersed. The medium can have components characterized by relatively low boiling points, e.g., in the range of 25° to 120° C. to facilitate subsequent removal of a portion or substantially all of the medium from the compositions of the invention or the components can have a higher boiling point to protect against removal from such compositions upon standing or heating. There is no criticality in an upper boiling point limitation on these liquids.

Representative liquids include mineral oils, alkanes of five to eighteen carbons, cycloalkanes of five or more carbons, corresponding alkyl-substituted cycloalkanes, aryl hydrocarbons, alkylaryl hydrocarbons, ethers such as dialkyl ethers, alkyl aryl ethers, cycloalkyl ethers, cycloalkylalkyl ethers, alkanols, alkylene glycols, polyalkylene glycols, alkyl ethers of alkylene glycols and polyalkylene glycols, dibasic alkanoic acid diesters, silicate esters, and mixtures of these. Specific examples include petroleum ether, Stoddard Solvent, pentane, hexane, octane, isooctane, undecane, tetradecane, cyclopentane, cyclohexane, isopropylcyclohexane, 1,4-dimethylcyclohexane, cyclooctane, benzene, toluene, xylene, ethyl benzene, tert-butyl-benzene, mineral oils, n-propylether, isopropylether, isobutylether, n-amylether, methyl-n-amylether, cyclohexylether, ethoxycyclohexane, methoxybenzene, isopropoxybenzene, p-methoxytoluene, methanol, ethanol, propanol, isopropanol, hexanol, n-octyl alcohol, n-decyl alcohol, alkylene glycols such as ethylene glycol and propylene glycol, diethyl ketone, dipropyl ketone, methylbutyl ketone, acetophenone, 1,2-difluorotetrachloroethane, dichlorofluoromethane, trichlorofluoromethane, acetamide, dimethylacetamide diethylacetamide, propionamide, diisooctyl azelate, ethylene glycol, polypropylene glycols, hexa-2-ethylbutoxy disiloxane, etc. Other dispersing media which may be used are mentioned in U.S. Pat. No. 4,468,339, column 9, line 29, to column 10, line 6, which is hereby incorporated by reference.

Also useful as dispersing media are the low molecular weight, liquid polymers, generally classified as oligomers, which include dimers, tetramers, pentamers, etc. Illustrative of this large class of materials are such liquids as the propylene tetramers, isobutylene dimers, low molecular weight polyolefins, such as poly(α-olefins), and the like.

From the standpoint of availability, cost, and performance, the alkyl, cycloalkyl, and aryl hydrocarbons represent a preferred class of disperse mediums. Liquid petroleum fractions represent another preferred class of disperse mediums. Included within these preferred classes are benzenes and alkylated benzenes, cycloalkanes and alkylated cycloalkanes, cycloalkenes and alkylated cycloalkenes such as found in naphthene-based petroleum fractions, and the alkanes such as found in the paraffin-based petroleum fractions. Petroleum ether, naphthas, mineral oils, Stoddard Solvent, toluene, xylene, etc., and mixtures thereof are examples of economical sources of suitable inert organic liquids which can function as the disperse medium in the colloidal disperse systems of the present invention. Mineral oil can serve by itself as the disperse medium and is preferred as an environmentally innocuous disperse medium.

In addition to the solid, metal-containing particles and the disperse medium, the disperse systems employed herein require a third component. This third component is an organic compound which is soluble in the disperse medium, and the molecules of which are characterized by a hydrophobic portion and at least one polar substituent. As explained, infra, the organic compounds suitable as a third component are extremely diverse. These compounds are inherent constituents of the disperse systems as a result of the methods used in preparing the systems. Further characteristics of the components are apparent from the following discussion of methods for preparing the colloidal disperse systems.

It is desirable that the overbased materials used to prepare the disperse system have a metal ratio of at least about 1.1 and preferably about 4.0. An especially suitable group of the preferred carboxylic acid overbased materials has a metal ratio of at least about 7.0. While overbased materials having a metal ratio of 75 have been prepared, normally the maximum metal ratio will not exceed about 50 and, in most cases, not more than about 40.

The overbased materials used in preparing the colloidal disperse systems utilized in the compositions of the invention contain from about 10% to about 70% by weight of metal-containing components. As explained hereafter, the exact nature of these metal containing components is not known. It is theorized that the metal base, the acidic material, and the organic material being overbased form a metal complex, this complex being the metal-containing component of the overbased material. On the other hand, it has also been postulated that the metal base and the acidic material form amorphous metal compounds which are dissolved in the inert organic reaction medium and the material which is said to be overbased. The material which is overbased may itself be a metal-containing compound, e.g., a carboxylic acid metal salt. In such a case, the metal containing components of the overbased material would be both the amorphous compounds and the acid salt. The remainder of the overbased materials comprise the inert organic reaction medium and any promoter which is not removed from the overbased product. For purposes of this application, the organic material which is subjected to overbasing is considered a part of the metal-containing components. Normally, the liquid reaction medium constitutes at least about 30% by weight of the reaction mixture utilized to prepare the overbased materials.

As mentioned above, the colloidal disperse systems used in the composition of the present invention are prepared by homogenizing a "conversion agent" and the overbased starting material. Homogenization is achieved by vigorous agitation of the two components, preferably at the reflux temperature or a temperature slightly below the reflux temperature. The reflux temperature normally will depend upon the boiling point of the conversion agent. However, homogenization may be achieved within the range of about 25° C. to about 200° C. or slightly higher. Usually, there is no real advantage in exceeding 150° C.

The concentration of the conversion agent necessary to achieve conversion of the overbased material is usually within the range of from about 1% to about 80% based upon the weight of the overbased material, excluding the weight of the inert organic solvent and any promoter present therein. Preferably at least about 10% and usually less than about 60% by weight of the conversion agent is employed. Concentrations beyond 60% appear to afford no additional advantages.

The terminology "conversion agent" as used herein is intended to describe a class of very diverse materials which possess the property of being able to convert the Newtonian homogeneous, single-phase, overbased materials into non-Newtonian colloidal disperse systems. The mechanism by which conversion is accomplished is not completely understood. However, with the exception of carbon dioxide, these conversion agents all possess active hydrogens. The conversion agents include lower aliphatic carboxylic acids, water, aliphatic alcohols, cycloaliphatic alcohols, arylaliphatic alcohols, phenols, ketones, aldehydes, amines, boron acids, phosphorus acids, and carbon dioxide. Mixtures of two or more of these conversion agents are also useful. Particularly useful conversion agents are discussed below.

The lower aliphatic carboxylic acids are those containing less than about eight carbon atoms in the molecule. Examples of this class of acids are formic acid, acetic acid, propionic acid, butyric acid, valeric acid, isovaleric acid, isobutyric acid, caprylic acid, heptanoic acid, chloroacetic acid, dichloroacetic acid, trichloroacetic acid, etc. Formic acid, acetic acid, and propionic acid are preferred, with acetic acid being especially suitable. It is to be understood that the anhydrides of these acids are also useful and, for the purposes of the specification and claims of this invention, the term acid is intended to include both the acid per se and the anhydride of the acid.

Useful alcohols include aliphatic, cycloaliphatic, and arylaliphatic mono- and polyhydroxy alcohols. Alcohols having less than about twelve carbons are especially useful, while the lower alkanols, i.e., alkanols having less than about eight carbon atoms are preferred for reasons of economy and effectiveness in the process. Illustrative are the alkanols such as methanol, ethanol, isopropanol, n-propanol, isobutanol, tertiary butanol, isooctanol, dodecanol, n-pentanol, etc.; cycloalkyl alcohols exemplified by cyclopentathol, cyclohexanol, 4-methylcyclohexanol, 2-cyclohexylethanol, cyclopentylmethanol, etc.; phenyl aliphatic alkanols such as benzyl alcohol, 2-phenylethanol, and cinnamyl alcohol; alkylene glycols of up to about six carbon atoms and mono-lower alkyl ethers thereof such as monomethylether of ethylene glycol, diethylene glycol, ethylene glycol, trimethylene glycol, hexamethylene glycol, triethylene glycol, 1,4-butanediol, 1,4-cyclohexanediol, glycerol, and pentaerythritol.

The use of a mixture of water and one or more of the alcohols is especially effective for converting the overbased material to colloidal disperse systems. Such combinations often reduce the length of time required for the process. Any water-alcohol combination is effective, but a very effective combination is a mixture of one or more alcohols and water in a weight ratio of alcohol to water of from about 0.05:1 to about 24:1. Preferably, at least one lower alkanol is present in the alcohol component of these water-alkanol mixtures. Water-alkanol mixtures wherein the alcoholic portion is one or more lower alkanols are especially suitable.

Phenols suitable for use as conversion agents include phenol, naphthol, ortho-cresol, para-cresol, catechol, mixtures of cresol, para-tertbutylphenol, and other lower alkyl substituted phenols, meta-polyisobutene (M.W.-350)-substituted phenol, and the like.

Other useful conversion agents include lower aliphatic aldehydes and ketones, particularly lower alkyl aldehydes and lower alkyl ketones such as acetaldehydes, propionaldehydes, butyraldehydes, acetone, methylethyl ketone, diethyl ketone. Various aliphatic, cycloaliphatic, aromatic, and heterocyclic amines are also useful providing they contain at least one amino group having at least one active hydrogen attached thereto. Illustrative of these amines are the mono- and di-alkylamines, particularly mono- and di-lower alkylamines, such as methylamine, ethylamine, propylamine, dodecylamine, methyl ethylamine, diethylamine; the cycloalkylamines such as cyclohexylamine, cyclopentylamine, and the lower alkyl substituted cycloalkylamines such as 3-methylcycohexylamine; 1,4-cyclohexylenealiamine; arylamines such as aniline, mono-, di-, and tri-, lower alkyl substituted phenyl amines, naphthylamines, 1,4-phenylene diamines; lower alkanol amines such as ethanolamine and diethanolamine; alkylenediamines such as ethylene diamine, triethylene tetramine, propylene diamines, octamethylene diamines; and heterocyclic amines such as piperazine, 4-aminoethylpiperazine, 2-octadecyl-imidazoline, and oxazolidine. Boron acids are also useful conversion agents and include boronic acids (e.g., alkyl-$B(OH)_2$ or aryl-$B(OH_2)$), boric acid (i.e., $H_3BO_3$), tetraboric acid, metaboric acid, and esters of such boron acids.

The phosphorus acids are useful conversion agents and include the various alkyl and aryl phosphinic acids, phosphinus acids, phosphonic acids, and phosphonous acids. Phosphorus acids obtained by the reaction of lower alkanols or unsaturated hydrocarbons such as polyisobutenes with phosphorus oxides and phosphorus sulfides are particularly useful, e.g., $P_3O_5$ and $P_2S_5$.

Carbon dioxide can be used as the conversion agent. However, it is preferable to use this conversion agent in combination with one or more of the foregoing conversion agents. For example, the combination of water and carbon dioxide is particularly effective as a conversion agent for transforming the overbased materials into a colloidal disperse system.

As previously mentioned, the overbased materials are single phase homogeneous systems. However, depending on the reaction conditions and the choice of reactants in preparing the overbased materials, there sometimes are present in the product insoluble contaminants. These contaminants are normally unreacted basic materials such as calcium oxide, barium oxide, calcium hydroxide, barium hydroxide, or other metal base materials used as a reactant in preparing the overbased material. It has been found that a more uniform colloidal disperse system results if such contaminants are removed prior to homogenizing the overbased material with the conversion agents. Accordingly, it is preferred that any insoluble contaminants in the overbased materials be removed prior to converting the material in the colloidal disperse system. The removal of such contaminants is easily accomplished by conventional techniques such as filtration or centrifugation. It should be understood, however, that the removal of these contaminants, while desirable for reasons just mentioned, is not an essential aspect of the invention and useful products can be obtained when overbased materials containing insoluble contaminants are converted to the colloidal disperse systems.

The conversion agents, or a proportion thereof, may be retained in the colloidal disperse system. The conversion agents are, however, not essential components of these disperse systems and it is usually desirable that as little of the conversion agents as possible be retained in the disperse systems. Since these conversion agents do not react with the overbased material in such a manner as to be permanently bound thereto through some type of chemical bonding, it is normally a simple matter to remove a major proportion of the conversion agents and, generally, substantially all of the conversion agents. Some of the conversion agents have physical properties which make them readily removable from the disperse systems. Thus, most of the free carbon dioxide gradually escapes from the disperse system during the homogenization process or upon standing thereafter. Since the liquid conversion agents are generally more volatile than the remaining components of the disperse system, they are readily removable by conventional devolatilization techniques, e.g., heating, heating at reduced pressures, and the like. For this reason, it may be desirable to select conversion agents which will have boiling points which are lower than the remaining components of the disperse system. This is another reason why the lower alkanols, mixtures thereof, and lower alkanol-water mixtures are preferred conversion agents.

Again, it is not essential that all of the conversion agent be removed from the disperse systems. In fact, useful disperse systems for employment in the resinous compositions of the invention result without removal of the conversion agents. However, from the standpoint of achieving uniform results, it is generally desirable to remove the conversion agents, particularly where they are volatile.

To better illustrate the colloidal disperse systems utilized in the invention, the procedure for preparing a preferred system is described below. Unless otherwise stated, all parts, percents, ratios, and the like are by weight, temperature is degrees Centigrade and room temperature (about 25° C.), and pressure is in atmospheres and about one atmosphere.

EXAMPLE 3

To 50 parts of the product produced according to Example 2 are added 100 parts mineral oil, which is charged to a 10 gallon glass-lined reactor equipped with a stirrer, thermowell, sub-surface gas inlet and a side-arm trap with a reflux condenser. The mixture is heated with stirring to 150° F. 22.5 parts of the PM3101™ described in Example 2 above and 7.5 parts tap water are charged to the reactor and the reactor is maintained at 150° F. with stirring for about 16 hours.

Water and alcohol is removed by conducting a nitrogen headspace purge while heating to 310° F. over a 5-hour period. The mixture is then vacuum-stripped to 10 mm Hg and 310° to 320° F. to remove additional volatile materials and cooled to room temperature with stirring. The product is the desired non-Newtonian metal overbased colloidal disperse system for use in the present invention in which the metal is calcium and the anion is oleate. The Brookfield Viscometer data for the product produced in Example 6 is tabulated below. The data is collected at 25° C.

BROOKFIELD VISCOMETER DATA
(Centipoises)

| R.p.m. | Product obtained in Example 3 |
|---|---|
| 2 | 201,000 |
| 4 | 108,000 |
| 10 | 47,500 |
| 20 | 26,000 |

The thixotropic index, provides an indication of gel strength, and may be calculated from the viscosity at 2 r.p.m. In this case, the product according to Example 3 has a thixotropic index of 7.7. Since a thixotropic index greater than 1.0 indicates gel (i.e., non-Newtonian) behavior, the above data shows that the product thus according to Example 3 has the rheology of a non-Newtonian gel.

As mentioned above, the colloidal disperse systems contain solid metal-containing particles which remain dispersed in the dispersing medium as colloidal particles. Ordinarily, the particles will not exceed 5.0 microns. However, by repeating certain portions of steps taken to produce the gelled overbased materials, it is possible to produce colloidal systems having a higher concentration of solid metal-containing particles and/or systems having a greater number average particle size than that obtained without such a procedure. This procedure, which the inventors call "rebasing", is basically the same as the general procedure for making non-Newtonian colloidal disperse systems described above, except that after the gellation process begins and before removing any volatile conversion agents from the reaction mixture, the gellation process is momentarily discontinued, additional inert, non-polar, organic solvent and metal base are added to the mixture, and the gellation process is resumed and completed as usual.

From the foregoing discussion and example, it is apparent that the solvent for the material which is overbased becomes the colloidal disperse medium or a component thereof. Of course, mixtures of other inert liquids can be substituted for the mineral oil or used in conjunction with the mineral oil prior to forming the overbased material.

It is also readily seen that the solid metal-containing particles formed in situ possess the same chemical composition as would the reaction products of the metal base and the acidic material used in preparing the overbased materials. Thus, the actual chemical identity of the metal containing particles formed in situ depends upon both the particular metal base or bases employed and the particular acidic material or materials reacted therewith. For example, if the metal base used in preparing the overbased material were calcium oxide and if the acidic material was a mixture of formic and acetic acids, the metal-containing particles formed in situ would be calcium formates and barium acetates.

However, the physical characteristics of the particles formed in situ in the conversion step are quite different from the physical characteristics of any particles present in the homogeneous single-phase overbased material which is subjected to the conversion. Particularly, such physical characteristics as particle size and structure are quite different. The solid metal-containing particles of the colloidal disperse systems are of a size sufficient for detection by X-ray diffraction. The overbased material prior to conversion is not characterized by the presence of these detectable particles.

X-ray diffraction and electron microscope studies have been made of both overbased organic materials and colloidal disperse systems prepared therefrom. These studies establish the presence in the disperse systems of the solid metal-containing salts. For example, in the disperse system prepared according to the above, the calcium carbonate is present as solid calcium carbonate having a particle size of about 40 to 50 Å (unit particle size) and interplanar spacing (dÅ) of 3.035. But X-ray diffraction studies of the overbased material from which it was prepared indicate the absence of calcium carbonate of this type. In fact, calcium carbonate present as such, if any, appears to be amorphous and in solution. While applicant does not intend to be bound by any theory offered to explain the changes which accompany the conversion step, it appears that conversion permits particle formation and growth. That is, the amorphous, metal-containing, apparently dissolved salts or complexes present in the overbased material form solid, metal-containing particles which by a process of particle growth become colloidal particles. Thus, in the above example, the dissolved amorphous calcium carbonate salt or complex is transformed into solid particles which then "grow". In this example, they grow to a size of 40 to 50 Å In many eases, these particles apparently are crystallites.

Regardless of the correctness of the postulated mechanism for in situ particle formation, the fact remains that no particles of the type predominant in the disperse systems are found in the overbased materials from which they are prepared. Accordingly, they are unquestionably formed in situ during conversion.

As these solid metal-containing particles formed in situ come into existence, they do so as pre-wet, pre-dispersed solid particles which are inherently uniformly distributed throughout the other components of the disperse system. The liquid disperse medium containing these pre-wet dispersed particles is readily incorporated into various polymeric compositions thus facilitating the uniform distribution of the particles throughout the polymeric resin composition. This pre-wet, pre-dispersed character of the solid metal-containing particles resulting from their in situ formation is, thus, an important feature of the disperse systems.

In the foregoing example, the third component of the disperse system (i.e., the organic compound which is soluble in the disperse medium and which is characterized by molecules having a hydrophobic portion and a polar substituent) is calcium carboxylate, $$R_1-\overset{\overset{\displaystyle O}{\|}}{C}-O-Ca-O-\overset{\overset{\displaystyle O}{\|}}{C}-R_1$$

wherein $R_1$ is the unsaturated linear $C_{8-50}$ aliphatic residue of the carboxylic acid. The polar substituent is the metal salt moiety,

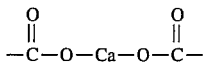

In other words, the hydrophobic portion of the organic compound is the residue of the organic material which is overbased minus its polar substituents. It is the hydrophobic portion of the molecule which renders the organic compound soluble in the solvent used in the overbasing process and later in the disperse medium.

The identity of the third essential component of the disperse system depends upon the identity of the starting materials (i.e., the material to be overbased and the metal base compound) used in preparing the overbased material. Once the identity of these starting materials is known, the identity of the third component in the colloidal disperse system is automatically established. Thus, from the identity of the original material, the identity of the hydrophobic portion of the third component in the disperse system is readily established as being the residue of that material minus the polar substituents attached thereto. The identity of the polar substituents on the third component is established as a matter of chemistry. If the polar groups on the material to be overbased undergo reaction with the metal base, for example, if they are acid functions, hydroxy groups, etc., the polar substituent in the final product will correspond to the reaction product of the original substituent and the metal base. On the other hand, if the polar substituent in the material to be overbased is one which does not react with metal bases, then the polar substituent of the third component is the same as the original substituent.

As previously mentioned, this third component can orient itself around the metal-containing particles to form micellar colloidal particles. Accordingly, it can exist in the disperse system as an individual liquid component dissolved in the disperse medium or it can be associated with the metal-containing particles as a component of micellar colloidal particles.

The change in rheological properties associated with conversion of a Newtonian overbased material into a non-Newtonian colloidal disperse system is demonstrated by the Brookfield Viscometer data derived from overbased materials and colloidal disperse systems prepared therefrom. Such data is disclosed in column 38, lines 13–63, of U.S. Pat. No. 4,468,339, and this disclosure is hereby fully incorporated herein by reference. This disclosure is reproduced in part below:

BROOKFIELD VISCOMETER DATA
(Centipoises)

| | Sample D | |
|---|---|---|
| R.p.m. | (1) | (2) |
| 6 | 114 | 8,820 |
| 12 | 103 | 5,220 |
| 30 | 100 | 2,892 |

The samples each are identified by two numbers, (1) and (2). The first comprises the overbased material and the second comprises the colloidal disperse system. The overbased material of Sample D is calcium overbased commercial higher fatty acid mixture having a metal ratio of about 5.

The data of all samples is collected at 25° C.

By comparing column (1) with column (2) for Sample D, it can be seen that the colloidal disperse system has a far greater viscosity than the overbased starting material.

The method of the present invention helps prevent a phenomenon known as "stick slip". Stick slip occurs when the static friction between components is greater than the dynamic friction between components when one of the components commences motion relative to the other. This phenomenon is most common when components are slideably engaged with each other, such as flat bearings, plain bearings, and leadscrew and nut assemblies. When increasing force is applied to such components undergoing the stick slip phenomenon, the components tend to resist movement, and then move with a sudden jerking motion when the force finally overcomes the resistance caused by static friction. When the intended movement is supposed to be smooth and precise, as with precision machine tools, this phenomenon can be particularly aggravating.

Stick slip has, for example, been known to cause chatter marks on work pieces for which a smooth even surface was intended, and is often the cause of calibration errors which cause tools and industrial equipment to process work pieces, or some other product, in a less precise way than what the tool or industrial equipment would ordinarily be capable of doing. Equipment intended to position a cutting, welding, drilling, grinding, etc., tool relative to a work piece, for example, needs to operate smoothly and precisely to achieve accurate results.

Stick slip may be measured using various test protocol if relative results are desired. One test for stick slip is that utilized by Cincinnati Milacron based on former ASTM procedure D2877-70, which consists of slowly traversing a base block beneath a top block with two ounces of a lubricant sample between the blocks using a Labeco Model 17900 stick-slip machine serial number 17900-5-71, commercially available from Laboratory Equipment Co., Mooresville, Ind., and test blocks made from pearlitic gray iron, HB179-201, available from Bennett Metal Products of Wilmington, Ohio. Deflection resulting from kinetic thrust force is observed while the block is moving from right to left and left to right. Deflection resulting from static thrust force is observed after this movement is terminated. The magnitude of the deflection is determined by dial indicators mounted on the apparatus. From the dial readings, the static coefficient of friction (US), kinetic coefficient of friction (UK), and stick-slip number US/UK are calculated.

Another method by which relative stick slip values may be determined is by using a modified antiwear testing device. A specific example is one in which a flat, self-aligning hardened steel rotor is operated so that it presses against a stationary narrow rimmed disk of an automatic transmission clutch material. The steel rotor is accelerated and then allowed to coast down to zero r.p.m. while loaded against the friction disk submerged in the lubricant test fluid and while speed and torque data are continuously obtained on a recording device. Such a low velocity friction apparatus (LVFA) which can be used to make these measurements may be made as follows:

A Shell Four Ball Test Machine from Precision Scientific Co. (Cat. No. 73603) is modified as follows:

1. The three ball cup, support, heater and torque arm are replaced with a suitable assembly that contains a narrow-rimmed disc instead of the three balls.

2. The single ball spindle arrangement is replaced with a flat rotor that is self-aligning and which rubs against the stationary narrow-rimmed disc.

3. The torque counter is replaced with a strain gauge load beam and chart recorder.

4. A flywheel is added to the rotating shaft to provide additional inertia for high speed decelerations.

5. A variable speed motor with a gear attachment is added for very slow constant speed testing.

The upper rotating specimen is a flat self-aligning rotor made from ketos tool steel hardened to Rockwell C-scale 57 and the lower stationary specimen is a flat, narrow-rimmed disc which, depending on the procedure, may be made of various materials. Before assembly, the rotating steel surfaces (rotors) are polished according to the following schedule to remove all traces of previous wear tracks and debris.

1. Rough Rotor-3-M-ite 180 grit paper
2. Smooth Rotor-3-M-ite 500 grit paper

Both rotors are then thoroughly cleaned in Stoddard solvent and air dried.

The rough disk is installed, 15 cc oil is added, and the assembly is run for 15 minutes under a 30 kg loa at 1000 r.p.m., and then the smooth rotor is installed and run for an additional 5 minutes as a break-in procedure.

This device is then cleaned, the paper clutch material is replaced, and the test lubricant composition is added. The disk is accelerated to 1000 r.p.m. and permitted to decelerate to zero r.p.m., while speed and torque data are continuously obtained by a recording device, such as a chart recorder. The static and dynamic coefficients of friction may be calculated from the rate of deceleration and torque data using standard calculations known in the art, and the stick slip coefficient may be calculated by dividing the static coefficient of friction by the dynamic coefficient of friction.

One aspect of the present invention is that friction reducing and extreme pressure/anti-wear properties are built into the Newtonian metal overbased salts of the unsaturated linear $C_{8-50}$ carboxylic acids and the corresponding non-Newtonian colloidal disperse systems, avoiding the necessity for auxiliary friction modifiers or auxiliary extreme pressure agents which add to lubricant cost and typically are a significant source of environmental, toxicological and/or cleanliness problems, as shown by the following data.

| Lubricant property | The Product of Example 2 | The Product of Example 3 |
|---|---|---|
| Coefficient of friction with 60 kg loading: | | |
| Static | 0.04 | 0.04 |
| Dynamic | 0.08 | 0.08 |
| Stick-Slip | 0.53 | 0.49 |
| 4-Ball Wear Test according to ASTM procedure D-2266 | | |
| Scar diameter (mm) | 0.30 | 0.33 |
| 4-Ball Extreme Pressure Test according to ASTM procedure D-2596: | | |
| Weld | — | 250 |
| Load wear index (kg) | — | 41 |
| Timken Test according to ASTM procedure D-2509 | | |
| OK load (lbs) | — | 40 |
| Dropping Point according to ASTM procedure D-2265 | | |
| Temperature (°F.) | — | 560 |

ASTM procedures D-2266, D-2596, D-2509 and D-2265 are well known procedures published by the American Society of Testing Materials and are hereby fully incorporated herein by reference.

The above coefficient of friction and stick-slip data are determined according to the LVFA method described above.

It is often advantageous to incorporate a minor amount of at least one higher molecular weight hydrocarbyl-substituted carboxylic acid or anhydride, or metal or amine salt thereof, into the lubricant compositions of the present invention, the hydrocarbyl substituent of the acid or anhydride having an average of at least about 30 carbon atoms. Suitable mono- and polycarboxylic acids are well known in the art and have been described in detail, for example, in the following U.S., British and Canadian patents: U.S. Pat. Nos. 3,024,237; 3,087,936; 3,163,603; 3,172,892; 3,215,707; 3,219,666; 3,231,587; 3,245,910; 3,254,025; 3,271,310; 3,272,743; 3,272,746; 3,278,550; 3,288,714; 3,306,907; 3,307,928; 3,312,619; 3,341,542; 3,346,354; 3,367,943; 3,373,111; 3,374,174; 3,381,022; 3,394,179; 3,454,607; 3,346,354; 3,470,098; 3,630,902; 3,652,616; 3,755,169; 3,868,330; 3,912,764; 4,234,435; and 4,368,133; British Patents 944, 136; 1,085,903; 1,162,436; and 1,440,219; and Canadian Patent 956,397. These patents are incorporated herein by reference.

As disclosed in the foregoing patents, there are several processes for preparing these higher molecular weight carboxylic acids. Generally, these processes involve the reaction of (1) an ethylenically unsaturated carboxylic acid, acid halide, anhydride or ester reactant with (2) an ethylenically unsaturated hydrocarbon containing at least about 30 aliphatic carbon atoms or a chlorinated hydrocarbon containing at least about 30 aliphatic carbon atoms at a temperature within the range of about 100–300° C. The chlorinated hydrocarbon or ethylenically unsaturated hydrocarbon reactant contains at least about 30 carbon atoms, more preferably at least about 40 carbon atoms, more preferably at least about 50 carbon atoms, and may contain polar substituents, oil-solubilizing pendant groups, and be unsaturated within the general limitations explained hereinabove. It is these hydrocarbon reactants which provide most of the aliphatic carbon atoms present in the acyl moiety of the final products.

When preparing the higher molecular weight carboxylic acids, the carboxylic acid reactant usually corresponds to the formula $R_o$—$(COOH)_n$, where $R_o$ is characterized by the presence of at least one ethylenically unsaturated carbon-to-carbon covalent bond and n is an integer from 1 to about 6 and preferably 1 or 2. The acidic reactant can also be the corresponding carboxylic acid halide, anhydride or ester. Ordinarily, the total number of carbon atoms in the acidic reactant will not exceed about 20, preferably this number will not exceed about 10 and generally will not exceed about 6. Preferably the acidic reactant will have at least one ethylenic linkage in an alpha, beta-position with respect to at least one carboxyl function. Exemplary acidic reactants are acrylic acid, methacrylic acid, maleic acid, maleic anhydride, fumaric acid, itaconic acid, itaconic anhydride, citraconic acid, citraconic anhydride, mesaconic acid, glutaconic acid, chloromaleic acid, aconitic acid, crotonic acid, methylcrotonic acid, sorbic acid, 3-hexenoic acid, 10-decenoic acid, and the like. Preferred acid reactants include acrylic acid, methacrylic acid, maleic acid, and maleic anhydride.

The ethylenically unsaturated hydrocarbon reactant and the chlorinated hydrocarbon reactant used in the preparation of these higher molecular weight carboxylic acids are preferably high molecular weight, substantially saturated petroleum fractions and substantially saturated olefin polymers and the corresponding chlorinated products. Polymers and chlorinated polymers derived from mono-olefins having from 2 to about 30 carbon atoms are preferred. Especially useful polymers are the polymers of 1-mono-olefins such as ethylene, propene, 1-butene, isobutene, 1-hexene, 1-octene, 2-methyl-1-heptene, 3-cyclohexyl-1-butene, and 2-methyl-5-propyl-1-hexene. Polymers of medial olefins, i.e., olefins in which the olefinic linkage is not at the terminal position, likewise are useful. These are exemplified by 2-butene, 3-pentene, and 4-octene.

Interpolymers of 1-mono-olefins such as illustrated above with each other and with other interpolymerizable olefinic substances such as aromatic olefins, cyclic olefins, and polyolefins, are also useful sources of the ethylenically unsaturated reactant. Such interpolymers include for example, those prepared by polymerizing isobutene with styrene, isobutene with butadiene, propene with isoprene, propene with isobutene, ethylene with piperylene, isobutene with chloroprene, isobutene with p-methylstyrene, 1-hexene with 1,3-hexadiene, 1-octene with 1-hexene, 1-heptene with 1-pentene, 3-methyl-1-butene with 1-octene, 3,3-dimethyl-1-pentene with 1-hexene, isobutene with styrene and piperylene, etc.

For reasons of oil solubility, the interpolymers contemplated for use in preparing the carboxylic acids of this invention are preferably substantially aliphatic and substantially saturated, that is, they should contain at least about 80% and preferably about 95% , on a weight basis, of units derived from aliphatic mono-olefins. Preferably, they will contain no more than about 5% olefinic linkages based on the total number of the carbon-to-carbon covalent linkages present.

In one embodiment of the invention, the polymers and chlorinated polymers are obtained by the polymerization of a $C_4$ refinery stream having a butene content of about 35% to about 75% by weight and an isobutene content of about 30% to about 60% by weight in the presence of a Lewis acid catalyst such as aluminum chloride or boron trifluoride. These polyisobutenes preferably contain predominantly (that is, greater than about 80% of the total repeat units) isobutene repeat units of the configuration.

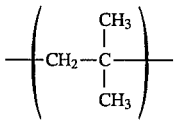

The chlorinated hydrocarbons and ethylenically unsaturated hydrocarbons used in the preparation of the higher molecular weight carboxylic acids can have number average molecular weights of up to about 100,000 or even higher, although preferred higher molecular weight carboxylic acids have molecular weights up to about 10,000, more preferably up to about 7500, more preferably up to about 5000. Preferred higher molecular weight carboxylic acids are those containing hydrocarbyl groups of at least about 30 carbon atoms, more preferably at least about 40 carbon atoms, more preferably at least about 50 carbon atoms.

The higher molecular weight carboxylic acids may also be prepared by halogenating a high molecular weight hydrocarbon such as the above-described olefin polymers to produce a polyhalogenated product, converting the polyhalogenated product to a polynitrile, and then hydrolyzing the polynitrile. They may be prepared by oxidation of a high molecular weight polyhydric alcohol with potassium permanganate, nitric acid, or a similar oxidizing agent. Another method involves the reaction of an olefin or a polar-substituted hydrocarbon such as a chloropolyisobutene with an unsaturated polycarboxylic acid such as 2-pentene-1,3,5-tricarboxylic acid prepared by dehydration of citric acid.

Monocarboxylic acids may be obtained by oxidizing a mono-alcohol with potassium permanganate or by reacting a halogenated high molecular weight olefin polymer with a ketene. Another convenient method for preparing monocarboxylic acid involves the reaction of metallic sodium with an acetoacetic ester or a malonic ester of an alkanol to form a sodium derivative of the ester and the subsequent reaction of the sodium derivative with a halogenated high molecular weight hydrocarbon such as brominated wax or brominated polyisobutene.

Monocarboxylic and polycarboxylic acids can also be obtained by reacting chlorinated mono- and polycarboxylic acids, anhydrides, acyl halides, and the like with ethylenically unsaturated hydrocarbons or ethylenically unsaturated substituted hydrocarbons such as the polyolefins and substituted polyolefins described hereinbefore in the manner described in U.S. Pat. No. 3,340,281, this patent being incorporated herein by reference.

The monocarboxylic and polycarboxylic acid anhydrides can be obtained by dehydrating the corresponding acids. Dehydration is readily accomplished by heating the acid to a temperature above about 70° C., preferably in the presence of a dehydration agent, e.g., acetic anhydride. Cyclic anhydrides are usually obtained from polycarboxylic acids having acid groups separated by no more than three carbon atoms such as substituted succinic or glutaric acid, whereas linear anhydrides are usually obtained from polycarboxylic acids having the acid groups separated by four or more carbon atoms.

The acid halides of the monocarboxylic and polycarboxylic acids can be prepared by the reaction of the acids or their anhydrides with a halogenating agent such as phosphorus tribromide, phosphorus pentachloride, or thionyl chloride.

Hydrocarbyl-substituted succinic acids and the anhydride, acid halide and ester derivatives thereof can be prepared by reacting maleic anhydride with a high molecular weight olefin or a chlorinated hydrocarbon such as a chlofinated polyolefin. The reaction involves merely heating the two reactants at a temperature in the range of about 100° C. to about 300° C., preferably, about 100° C. to about 200° C. The product from this reaction is a hydrocarbyl-substituted succinic anhydride wherein the substituent is derived from the olefin or chlorinated hydrocarbon. The product may be hydrogenated to remove all or a portion of any ethylenically unsaturated covalent linkages by standard hydrogenation procedures, if desired. The hydrocarbyl-substituted succinic anhydrides may be hydrolyzed by treatment with water or steam to the corresponding acid and either the anhydride or the acid may be converted to the corresponding acid halide or ester by reacting with a phosphorus halide, phenol or alcohol.

Useful higher molecular weight hydrocarbyl-substituted succinic acids and anhydrides are represented by the formulae

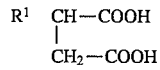

(IA)

or

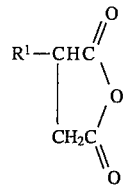

(IIA)

wherein in Formulae IA and IIA, $R^1$ contains at least about 30 carbon atoms, more preferably at least about 40 carbon atoms, more preferably at least about 50 carbon atoms. The number average molecular weight for $R^1$ will generally not exceed about 100,000, preferably it will not exceed about 10,000, more preferably it will not exceed about 7500, more preferably it will not exceed about 5000.

A preferred group of hydrocarbyl-substituted carboxylic acids and anhydrides are the polyisobutenyl succinic acids and anhydrides wherein the polyisobutenyl group contains an average of at least about 30 carbon atoms, or a metal or amine salt thereof, including any of the preferred ranges set forth above for number of carbon atoms or molecular weight of the carboxylic acid or anhydride.

The inventors have discovered that including a minor amount of the above-described higher molecular weight carboxylic acids and anhydrides, and metal and amine salts thereof, often results in an unexpected improvement in the friction-modifying and extreme pressure/antiwear properties of the lubricant compositions of the present invention. The higher molecular weight carboxylic acids and anhydrides may be present in amounts up to 40 percent by weight, preferably in amounts up to 20 percent by weight, and more preferably in amounts up to 10 percent by weight, and, when present, at least in an amount to provide a property improving effect, preferably at least 1 percent by weight, and more preferably 5 percent by weight.

Functional Additives:

The functional additives that can be dispersed with the compositions of this invention are generally well known to those of skill in the art as mineral oil and fuel additives. They generally are not soluble in water beyond the level of one gram per 100 milliliters at 25° C., and often are less soluble than that. Their mineral oil solubility is generally about at least one gram per liter at 25° C.

Among the functional additives are extreme pressure agents, corrosion and oxidation inhibiting agents, such as sulfurized organic compounds, particularly hydrocarbyl sulfides and polysulfides (such as alkyl and aryl sulfides and polysulfides including olefins, aldehydes and esters thereof, e.g., benzyl disulfide, benzyl trisulfide, dibutyltetrasulfide, sulfurized esters of fatty acid, sulfurized alkyl phenols, sulfurized dipentenes and sulfurized terpenes). Among these sulfurized organic compounds, the hydrocarbyl polysulfides are preferred.

As previously mentioned, one of the advantages of the lubricants used according to the present invention is frequently that they contain no active sulfur and thus may be used on a wide variety of metals, including those which are stained by active sulfur compounds. However, it is sometimes advantageous, especially when the lubricant contains relatively small amounts of certain compositions containing sulfur, specifically extreme pressure/antiwear agents.

The particular species of the sulfurized organic compound is not particularly critical to the present invention. However, it is preferred that the sulfur be incorporated in the organic compound as the sulfide moiety, i.e., in its divalent oxidation state and that it is oil-soluble. The sulfurized organic compound may be prepared by sulfurization of an aliphatic, arylaliphatic or alicyclic hydrocarbon. Olefinic hydrocarbons containing from about 3 to about 30 carbon atoms are preferred for the purposes of the present invention.

The olefinic hydrocarbons which may be sulfurized are diverse in nature. They contain at least one olefinic double bond, which is defined as a non-aromatic double bond; that is, one connecting two aliphatic carbon atoms. In its broadest sense, the olefinic hydrocarbon may be defined by the formula $R^7R^8C{=}CR^9R^{10}$, wherein each of $R^7$, $R^8$, $R^9$ and $R^{10}$ is hydrogen or a hydrocarbon (especially alkyl or alkenyl) radical. Any two of $R^7$, $R^8$, $R^9$ and $R^{10}$ may also together form an alkylene or substituted alkylene group; i.e., the olefinic compound may be alicyclic.

Monoolefinic and diolefinic compounds, particularly the former, are preferred in the preparation of the sulfurized organic compound, and especially terminal monoolefinic hydrocarbons; that is, those compounds in which $R^9$ and $R^{10}$ are hydrogen and $R^7$ and $R^8$ are alkyl (that is, the olefin is aliphatic). Olefinic compounds having about 3-3- and especially about 3–20 carbon atoms are particularly desirable.

Propylene, isobutene and their dimers, trimers and tetramers, and mixtures thereof are especially preferred olefinic compounds. Of these compounds, isobutene and diisobutene are particularly desirable because of their availability and the particularly high sulfur-containing compositions which can be prepared therefrom.

The sulfurizing reagent used from the preparation of sulfurized organic compounds may be, for example, sulfur, a sulfur halide such as sulfur monochloride or sulfur dichloride, a mixture of hydrogen sulfide and sulfur or sulfur dioxide, or the like. Sulfur-hydrogen sulfide mixtures are often preferred and are frequently referred to hereinafter; however, it will be understood that other sulfurization agents may, when appropriate, be substituted therefor.

The amounts of sulfur and hydrogen sulfide per mole of olefinic compound are, respectively, usually about 0.3–3.0 gram-atoms and about 0.1–1.5 moles. The preferred ranges are about 0.5–2.0 gram-atoms and about 0.4–1.25 moles respectively, and the most desirable ranges are about 1.2–1.8 gram-atoms and about 0.4–0.8 mole respectively.

The temperature range in which the sulfurization reaction is carried out is generally about 50°–350° C. The preferred range is about 100°–200° C., with about 125°–180° C. being especially suitable. The reaction is often preferably conducted under superatmospheric pressure; this may be and usually is autogenous pressure (i.e., the pressure which naturally develops during the course of the reaction) but may also be externally applied pressure. The exact pressure developed during the reaction is dependent upon such factors as the design and operation of the system, the reaction temperature, and the vapor pressure of the reactants and products and it may vary during the course of the reaction.

It is frequently advantageous to incorporate materials useful as sulfurization catalysts in the reaction mixture. These materials may be acidic, basic or neutral, but are preferably basic materials, especially nitrogen bases including ammonia and amines, most often alkylamines. The amount of catalyst used is generally about 0.05–2.0% of the weight of the olefinic compound. In the case of the preferred ammonia and amine catalysts, about 0.0005–0.5 mole per mole of olefin is preferred, and about 0.001–0.1 mole is especially desirable.

Following the preparation of the sulfurized mixture, it is preferred to remove substantially all low boiling materials, typically by venting the reaction vessel or by distillation at atmospheric pressure, vacuum distillation or stripping, or passage of an inert gas such as nitrogen through the mixture at a suitable temperature and pressure.

A further optional step in the preparation of sulfurized organic compound is the treatment of the sulfurized product, obtained as described hereinabove, to reduce active sulfur. An illustrative method is treatment with an alkali metal sulfide. Other optional treatments may be employed to remove insoluble byproducts and improve such qualities as the odor, color and staining characteristics of the sulfurized compositions.

In one aspect of the present invention, a lubricant composition containing the metal overbased salt of a carboxylic acid comprising an unsaturated linear hydrocarbon group of from about 8 to about 50 carbon atoms is provided which contains substantially no active sulfur as measured by ASTM procedure D130 which is hereby incorporated herein by reference. Such compositions have the advantage that compositions eliminate problems often associated with lubricants containing active sulfur, such as unpleasant odors, staining of copper surfaces, etc.

However, it is sometimes desirable to allow active sulfur to be present in the lubricant compositions of the present invention, particularly when the metal overbased unsaturated linear hydrocarbon-containing carboxylates used in the present invention have a high metal ratio, such as a metal ratio of 15 or more. Such active sulfur-containing compositions are well suited for applications in which the extreme pressure/antiwear requirements are high, such as in heavy industrial machinery, or applications in which the presence of active sulfur is not a significant disadvantage, such as when there is little, if any, human contact with the lubricant.

U.S. Pat. No. 4,119,549 is incorporated by reference herein for its disclosure of suitable sulfurization products useful as auxiliary extreme pressure/anti-wear agents in the present invention. Several specific sulfurized compositions are described in the working examples thereof. The following examples illustrate the preparation of two such compositions.

EXAMPLE A

Sulfur (629 parts, 19.6 moles) is charged to a jacketed high-pressure reactor which is fitted with an agitator and internal cooling coils. Refrigerated brine is circulated through the coils to cool the reactor prior to the introduction of the gaseous reactants. After sealing the reactor, evacuating to about 6 torr and cooling, 1100 parts (19.6 moles) of isobutene, 334 parts (9.8 moles) of hydrogen sulfide and 7 parts of n-butylamine are charged to the reactor. The reactor is heated, using steam in the external jacket, to a temperature of about 171° C. over about 1.5 hours. A maximum pressure of 720 psig. is reached at about 138° C. during this heat-up. Prior to reaching the peak reaction temperature, the pressure starts to decrease and continues to decrease steadily as the gaseous reactants are consumed. After about 4.75 hours at about 171° C. the unreacted hydrogen sulfide and isobutene are vented to a recovery system. After the pressure in the reactor has decreased to atmospheric, the sulfurized product is recovered as a liquid.

EXAMPLE B

Following substantially the procedure of Example 3, 773 parts of diisobutene is reacted with 428.6 parts of sulfur and 143.6 parts of hydrogen sulfide in the presence of 2.6 parts of n-butylamine, under autogenous pressure at a temperature of about 150°–155° C. Volatile materials are removed and the sulfurized product is recovered as a liquid.

The functional additive can also be chosen from phosphorus-containing materials and include phosphosulfurized hydrocarbons such as the reaction product of a phosphorus sulfide with terpenes, such as turpentine, or fatty esters, such as methyl oleate, phosphorus esters such as hydrocarbyl phosphites, particularly the acid dihydrocarbyl and trihydrocarbyl phosphites such as dibutyl phosphites, diheptyl phosphite, dicyclohexyl phosphite, pentylphenyl phosphite, dipentylphenyl phosphite, tridecyl phosphite, distearyl phosphite, dimethyl naphthyl phosphite, oleyl 4-pentylphenyl phosphite, polypropylene-substituted phenyl phosphite, diisobutyl-substituted phenyl phosphite; metal salts of acid phosphate and thiophosphate hydrocarbyl esters such as metal phosphorodithioates including zinc dicyclohexyl phosphorodithioate, zinc dioctylphosphorodithioate, barium di(heptylphenol)-phosphorodithioate, cadmium dinonylphosphorodithioate, and the zinc salt of a phosphorodithioic acid products by the reaction of phosphorus pentasulfide with an equimolar mixture of isopropyl alcohol and n-hexyl alcohol.

Another type of suitable functional additives (C) includes carbamates and their thioanalogs such as metal thiocarbamates and dithiocarbamates and their esters, such as zinc dioctyldithiocarbamate, and barium heptylphenyl dithiocarbamate.

Other types of suitable functional additives (C) include overbased and gelled overbased carboxylic, sulfonic and phosphorus acid salts, high molecular weight carboxylate esters, and nitrogen-containing modifications thereof, high molecular weight phenols, condensates thereof; high molecular weight amines and polyamines; high molecular weight carboxylic acid/amino compound products, etc. Typically, these functional additives are anti-wear, extreme pressure, and/or load-carrying agents, such as the well known metal salts of acid phosphates and acid thiophosphate hydrocarbyl esters. An example of the latter are the well known zinc di(alkyl) or di(aryl) dithiophosphates. Further descriptions of these and other suitable functional additives (C) can be found in the aforementioned treatises "Lubricant Additives" which are hereby incorporated by reference for their disclosures in this regard.

The amount of the metal overbased carboxylate combined with auxiliary extreme pressure agent for rail lubricant compositions of the present invention may vary over a wide range. For example, the weight ratio of metal overbased carboxylate to auxiliary extreme pressure agent may range from about 1:1 to essentially no auxiliary extreme pressure agent at all. However, as a preferred range, the weight ratio of metal overbased carboxylate to auxiliary extreme pressure agent is from about 10:1 to about 50:1, particularly when the metal overbased carboxylate contains a metal ratio, as defined above, greater than 15.

A pour point depressant amount of a pour point depressant may also be incorporated into lubricant compositions of the present invention which have measurable pour point. The use of such pour point depressants in oil-based compositions to improve low temperature properties of oil-based compositions is well known in the art. See, for example, page 8 of "Lubricant Additives" by C. V. Smalheer and R. Kennedy Smith (Lezius-Hiles Co. publishers, Cleveland, Ohio, 1967), which is incorporated herein by reference.

Examples of useful pour point depressants are polymethacrylates; polyacrylates; polyacrylamides; condensation products of haloparaffin waxes and aromatic compounds; vinyl carboxylate polymers; and terpolymers of dialkylfumarates, vinyl esters of fatty acids and alkyl vinyl ethers. Pour point depressants useful for the purposes of this invention, techniques for their preparation and their uses are described in U.S. Pat. Nos. 2,387,501; 2,015,748; 2,655,479; 1,815,022; 2,191,498; 2,666,746; 2,721,877; 2,721,878; and 3,250,715 which are hereby incorporated by reference.

In one aspect of the lubricant compositions used in the present invention, a tackiness agent may also be present in an amount effective to aid in adhering the lubricant composition to slideably engaging components. The tackiness agent may, for example, be present in an amount in the range from about 0.1% to 4% by weight of the lubricant composition, preferably in the range from about 0.5% to about 2% by weight.

The metal overbased carboxylate and, optionally, one or more functional additives may be added separately or as a mixture to a base oil stock or base grease stock to obtain an oil or grease composition for use as a lubricant in the present invention, or may be combined separately or as a mixture with a non-Newtonian overbased material. The amount of the metal overbased salt of the unsaturated linear $C_{8-50}$ hydrocarbon-containing carboxylic acid is preferably at least 2% by weight, more preferably at least 8% by weight, and may be present in amounts of at least 20%, 40%, 80% by weight, or neat (100%) by weight, depending on the type of application for which it is intended. The combination of Newtonian or non-Newtonian metal overbased carboxylate and functional additive may also be used neat (i.e., with essentially no other additives or components).

Grease compositions or base grease stocks are derived from both mineral and synthetic oils. The synthetic oils include polyolefin oils (e.g., polybutene oil, decene oligimer, and the like), synthetic esters (e.g., dinonyl sebacate, trioctanoic acid ester of trimethylolpropane, and the like), polyglycol oils, and the like. The grease composition is then made from these oils by adding a thickening agent such as a sodium, calcium, lithium, or aluminum salts of fatty acids such as stearic acid. To this base grease stock, then may be blended the above-described metal overbased carboxylate as well as other known or conventional additives such as those described above. The grease composition of the present invention may contain from about 1 weight percent to about 99 weight percent of the metal overbased carboxylate and from 0.1 percent to about 5 weight percent of auxiliary extreme pressure agent of the additive of the present invention. As a preferred embodiment, the effective amount of the metal overbased carboxylate in the grease composition will range from about 5 weight percent to about 50 weight percent and the effective amount of auxiliary extreme pressure agent will range from about 0.5 weight percent to about 2 weight percent.

Suitable lubricating oils include natural and synthetic oils and mixtures thereof.

Natural oils are often preferred; they include liquid petroleum oils and solvent-treated or acid-treated mineral lubricating oils of the paraffinic, naphthenic and mixed paraffinic-naphtenic types. Oils of lubricating viscosity derived from coal or shale are also useful base oils.

Synthetic lubricating oils include hydrocarbon oils and halosubstituted hydrocarbon oils such as polymerized and interpolymerized olefins [e.g., polybutylenes, polypropylenes, propylene-isobutylene copolymers, chlorinated polybutylenes, poly(1-hexenes), poly(1-octenes), poly(1-decenes)]; alkylbenzenes [ e.g., dodecylbenzenes, tetradecylbenzenes, dinonylbenzenes, di(2-ethylhexyl)benzenes]; polyphenyls (e.g., biphenyls, terphenyls, alkylated polyphenyls); and alkylated diphenyl ethers and alkylated diphenyl sulfides and the derivatives, analogs and homologs thereof.

Alkylene oxide polymers and interpolymers and derivatives thereof where the terminal hydroxyl groups have been modified by esterification, etherification, etc., constitute another class of known synthetic lubricating oils. These are exemplified by polyoxyalkylene polymers prepared by polymerization of ethylene oxide or propylene oxide, the alkyl and aryl ethers of these polyoxyalkylene polymers (e.g., methyl-polyisopropylene glycol ether having an average molecular weight of 1000, diphenyl ether of polyethylene glycol having a molecular weight of 500–1000, diethyl ether of polypropylene glycol having a molecular weight of 1000–1500); and mono- and polycarboxylic esters thereof, for example, the acetic acid esters, mixed C3-C8 fatty acid esters and C13 Oxo acid diester of tetraethylene glycol.

Another suitable class of synthetic lubricating oils comprises the esters of dicarboxylic acids (e.g., phthalic acid, succinic acid, alkyl succinic acids and alkenyl succinic acids, maleic acid, azelaic acid, suberic acid, sebacic acid, fumaric acid, adipic acid, linoleic acid dimer, malonic acid, alkyl malonic acids, alkenyl malonic acids) with a variety of alcohols (e.g., butyle alcohol, hexyl alcohol, dodecyl alcohol, 2-ethylhexyl alcohol, ethylene glycol, diethylene glycol monoether, propylene glycol). Specific examples of these esters include dibutyl adipate, di(2-ethylhexyl) sebacate, di-n-hexyl fumarate, dioctyl sebacate, diisoctyl azelate, diisodecyl azelate, dioctyl phthalate, didecyl phthalate, dieicosyl sebacate, the 2-ethylhexyl diester of linoleic acid dimer, and the complex ester formed by reacting one mole of sebacic acid with two moles of tetraethylene glycol and two moles of 2-ethyl-hexanoic acid.

Esters useful as synthetic oils also include those made from C5 to C12 monocarboxylic acids and polyols and polyol ethers such as neopentyl glycol, trimethylolpropane, pentraerythritol, dipentaerythritol and tripentaerythritol.

Silicon-based oils such as the polyalkyl-, polyaryl-, polyalkoxy-, or polyaryloxysiloxane oils and silicate oils comprise another useful class of synthetic lubricants; they include tetraethyl silicate, tetraisopropyl silicate, tetra-(2-ethylhexyl)silicate, tetra-(4-methyl-2-ethylhexyl)silicate, tetra-(p-tert-butylphenyl)silicate, hexa-(4-methyl-2-pentoxy)disiloxane, poly(methyl)siloxanes and poly(methylphenyl)siloxanes. Other synthetic lubricating oils include liquid esters of phosphorus-containing acids (e.g., tricresyl phosphate, trioctyl phosphate, diethyl ester of decylphosphonic acid) and polymeric tetrahydrofurans.

Unrefined, refined and rerefined oils can be used as component A according to the present invention. Unrefined oils are those obtained directly from a natural or synthetic source without further purification treatment. For example, a shale oil obtained directly from retorting operations, a petroleum oil obtained directly from distillation or ester oil obtained directly from an esterification process and used without further treatment would be an unrefined oil. Refined oils are similar to the unrefined oils except they have been further treated in one or more purification steps to improve one or more purification steps to improved one or more properties. Many such purification techniques, such as distillation, solvent extraction, acid or base extraction, filtration and percolation are known to those skilled in the art. Rerefined oils are obtained by processes similar to those used to obtain refined oils applied to refined oils which have been already used in service. Such rerefined oils are also known as reclaimed or reprocessed oils and often are additionally processed by techniques for removal of spent additives and oil breakdown products.

Concentrates for making lubricant compositions are also contemplated as being within the scope of the present invention. Concentrates may comprise a substantially neutral, normally liquid, organic diluent, and, dissolved or stably dispersed therein, about 10 to 90 weight percent of the above-described metal overbased carboxylic acid comprising at least one linear unsaturated hydrocarbon containing from about 8 to about 50 carbon atoms.

Other additives which may optionally be present in the lubricants for use in this invention include:

Antioxidants, typically hindered phenols.

Surfactants, usually non-ionic surfactants such as oxyalkylated phenols, cationic surfactants such as aromatic amines, and the like.

Corrosion, wear and rust inhibiting agents.

Friction modifying agents, of which the following are illustrative: alkyl or alkenyl phosphates or phosphites in which the alkyl or alkenyl group contains from about 10 to about 40 carbon atoms, and metal salts thereof, especially zinc salts; C 10–20 fatty acid amides; C 10–20 alkyl amines, especially tallow amines and ethoxylated derivatives thereof; salts of such amines with acids such as boric acid or phosphoric acid which have been partially esterified as noted above; C 10–20 alkyl-substituted imidazolines and similar nitrogen heterocycles.

As mentioned above, the present invention is directed to a method for reducing friction between slideably engaging components such as flat bearings, rotating bearings, leadscrews and nuts, gears, and hydraulic systems. These are described in greater detail below.

Flat bearings basically include any components which come in slideable contact with and move transversely relative to one another in other than a rotating relation to one another. Typical fiat bearing type components include slideways, guides and ways.

Rotating bearings include any components which come in rotating contact with one another. This category is often further subdivided into plain bearings and rolling bearings. Typical plain bearing type components include, for example, journal bearings, guide bearings, and thrust bearings.

Journal bearings basically comprise components which are in slideable contact with a rotating second component wherein the contact is tangential to the direction of rotation. The rotation of the second component may either be reciprocal or bidirectional rotation or rotation in a single direction only. Examples are a component mounted in rotating relation to a shaft, a component provided with an opening such that a shaft terminating within the opening or passing through the opening can rotate in relation to the opening, sleeve bearings, etc.

Guide bearings basically comprise components which undergo motion other than pure rotation while in slideable contact with a rotating component. A typical example is a cam and cam follower assembly in which the rotation of the cam causes movement of the cam follower.

Thrust bearings comprise a component which is in slideable contact with a rotating component wherein the contact is in an axial direction to the direction of rotation. Examples of thrust bearings are a shaft terminating and rotating in a socket in which the shaft end is in contact with the socket, a shaft and ring washer assembly for rotation of a component relative to the shaft, a ball bearing and socket assembly for rotation about the ball bearing, etc.

Roller (i.e., anti-friction) bearings are those which contain rolling elements in contact with at least two components for reducing friction between components. Relative movement may be in any direction, such as linear, rotational, reciprocal, etc. Well known anti-friction bearings include ball bearings, roller bearings, tapered bearings, and needle bearings interposed between components which permit rolling of the anti-friction bearings between them.

A leadscrew and nut assembly is often used wherever there is a desire to directly translate a rotating motion to a transverse motion. A typical example would be a leadscrew advancing toward a workpiece for the purpose of cutting, grinding, or simply holding the workpiece. Another example is the leadscrew and nut assembly used to control the position of airplane wing aerodynamic control surfaces. A third example is the drive screw assembly generally used to accurately position the read or write head of an optical disk drive used to store digital information, such as those optical disk drives now being used as compact disk digitally recorded music players. Numerous other examples could be cited.

Gears are components which are designed to transfer rotational motion from a first rotating component to a second component in contact with the first component and having structure which mechanically engage with the first component for mechanically transferring the rotational motion. Examples are worm gears, spiral gears, herringbone gears, hypoid gears, helical gears, beveled gears, etc.

Hydraulic systems basically include any system in which a mechanism is operated by the resistance offered or the pressure transmitted when a quantity of a liquid is forced through a comparatively small orifice or through a tube. Examples of hydraulic systems include hydraulic presses, hydraulic brakes, etc. In such systems, the metal overbased carboxylates having an unsaturated linear hydrocarbon group according to the present invention may conveniently be used as the hydraulic fluid to provide the liquid required to operate the system and, at the same time, provide excellent extreme pressure lubrication properties.

Pneumatic devices include any device in which a mechanism is operated by the resistance offered to a gas pressure differential. Such devices include rotary or linear displacement of a component situated in a chamber having at least one orifice for the entry and exit of a gas. Air compressors, pneumatic power tools, jack hammers, etc., are some examples of pneumatic devices. The metal overbased carboxylates having an unsaturated linear hydrocarbon group according to the present invention are applied to slideably engaging surfaces of relatively slideable components normally found in such pneumatic devices, such as sliding pistons in cylinders, etc., to reduce friction and wear between the slideably engaging surfaces of said components.

The lubricating method of the present invention is most advantageous relative to previous lubricating methods with respect to those slideably engaged components having more sliding, as opposed to combined rolling and sliding, contact with one another. Flat bearings of all types, plain bearings of all types, and worm gears, for example, are preferred components for the method of the present invention in view of the exceptional level of friction-modifying and extreme pressure/anti-wear properties required by such components.

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

We claim:

1. A method for reducing friction between relatively slideable components comprising applying to a slideably engaging surface of a slideable component a lubricating amount of a lubricating composition comprising non-Newtonian colloidal disperse system comprising (1) solid metal-containing colloidal particles dispersed in (2) a disperse medium of at least one inert organic liquid and (3) as a third component at least one organic compound which is soluble in said disperse medium and contains a hydrophobic portion and at least one polar substituent.

2. The method of claim 1 wherein the number average particle size for said colloidal particles is from about 0.02 to about 5 microns.

3. The method of claim 1 wherein said colloidal particles are metal salts of inorganic acids, low molecular weight organic acids, hydrates thereof, or mixtures of these.

4. The method of claim 1 wherein said colloidal particles comprise alkali or alkaline earth metal salts.

5. The method of claim 1 wherein said colloidal particles are selected from the group consisting of alkali or alkaline earth metal acetates, formates, carbonates, sulfides, sulfites, sulfates, thio-sulfates and halides.

6. The method of claim 1 wherein said disperse medium is at least one organic liquid selected from the group consisting of mineral oil, petroleum ether, naphthas, Stoddard Solvent, pentane, hexane, octane, isooctane, undecane, tetradecane, cyclopentane, cyclohexane, isopropylcyclohexane, 1,4-di-methylcyclohexane, cycloocctane, benzene, toluene, xylene, ethyl benzene, tert-butylbenzene, n-propylether, isopropylether, isobutyl-ether, amylether, methyl-n-amylether, cyclohexylether, ethoxycyclohexane, methoxybenzene, isopropoxybenzene, p-methoxytoluene, methanol, ethanol, propanol, isopropanol, hexanol, n-octyl alcohol, n-decyl alcohol, ethylene glycol, propylene glycol, diethyl ketone, dipropyl ketone, methylbutyl ketone, acetophenone, 1,2-diflurotetrachloroethane, dichlorofluoromethane, trichlorofluoromethane, acetamide, dimethylacetamide, diethylacetamide, propionamide, diisooctyl azelate, ethylene glycol, polypropylene glycol, hexa-2-ethylbutoxy disiloxane, propylene tetramer, isobutylene dimer, and polyolefin.

7. The method of claim 1 wherein said third component comprises at least one alkali or alkaline earth metal salt of a carboxylic acid, said carboxylic acid having a linear unsaturated hydrocarbon group containing from about 8 to about 50 carbon atoms.

8. The method of claim 7 wherein said linear unsaturated hydrocarbon group contains from about 12 to about 25 carbon atoms.

9. The method of claim 7 wherein said carboxylic acid is selected from the group consisting of tall oil acid, linoleic acid, abietic acid, linolenic acid, palmitoleic acid, oleic acid, ricinoleic acid, and alkenyl succinic acid wherein the alkenyl group contains about 8 to about 50 carbon atoms.

10. The method of claim 1 wherein said non-Newtonian colloidal disperse system is derived from an overbased material having a metal ratio of at least about 1.1.

11. The method of claim 10 wherein said overbased material comprises at least one metal overbased salt of a carboxylic acid wherein the metal is selected from the group consisting of lithium, calcium, sodium, barium, magnesium, and mixtures thereof and the carboxylic acid comprises at least one linear unsaturated hydrocarbon group containing from about 8 to about 50 carbon atoms.

12. The method of claim 1 wherein said lubricating composition is applied to a flat bearing, journal bearing, guide bearing, thrust bearing, roller bearing, gear, lead screw and nut, hydraulic system, pneumatic device or slideaway.

13. The method of claim 2 wherein said lubricating composition is applied to a worm gear, spiral gear, herringbone gear, hypoid gear, helical gear, or beveled gear.

14. The method of claim 1 wherein said lubricating composition further comprises a minor amount of at least one hydrocarbyl-substituted carboxylic acid or anhydride, or metal or amine salt thereof, the hydrocarbyl substituent of said acid or anhydride having an average of at least about 30 carbon atoms.

15. The method of claim 1 wherein said lubricating composition further comprises at least one extreme pressure agent, antiwear agent, corrosion inhibitor, oxidation inhibitor, pour point depressant or tackiness agent.

16. The method of claim 1 wherein said lubricating composition further comprises an antioxidant, surfactant, corrosion inhibiting agent, wear inhibiting agent, rust inhibiting agent, friction modifying agent.

17. The method of claim 1 wherein said lubricating composition is in the form of a grease.

18. A method for reducing friction between relatively slidable components comprising applying to a slidably engaging surface of a slidable component a lubricating amount of a lubricating composition comprising a non-Newtonian colloidal disperse system comprising (1) calcium carbonate colloidal particles dispersed in (2) mineral oil and (3) as a third component a tall oil fatty acid or salt.

* * * * *